US006556803B2

(12) United States Patent
Akema et al.

(10) Patent No.: US 6,556,803 B2
(45) Date of Patent: Apr. 29, 2003

(54) IMAGE FORMING APPARATUS FOR SYNTHETIC RESIN SHEETS

(75) Inventors: Hiroshi Akema, Miyagi (JP); Noboru Onodera, Miyagi (JP); Haruki Morikawa, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/916,499

(22) Filed: Jul. 30, 2001

(65) Prior Publication Data

US 2002/0021921 A1 Feb. 21, 2002

(30) Foreign Application Priority Data

Jul. 28, 2000 (JP) ..... 2000-229288
Jul. 31, 2000 (JP) ..... 2000-231758

(51) Int. Cl.[7] ..... G03G 15/01
(52) U.S. Cl. ..... 399/303; 399/322
(58) Field of Search ..... 399/45, 303, 304, 399/305, 312, 316, 317, 318, 322, 389, 400, 388; 346/137; 347/152, 262, 264; 101/474, DIG. 37, 475; 430/126

(56) References Cited

U.S. PATENT DOCUMENTS 4,437,754 A * 3/1984 Idstein ..... 101/DIG. 37
4,723,145 A * 2/1988 Takada et al. ..... 347/119
4,864,358 A * 9/1989 Kasahara ..... 399/132
5,317,337 A * 5/1994 Ewaldt ..... 347/2
5,462,374 A * 10/1995 Kohno ..... 101/44
5,542,768 A * 8/1996 Rother et al. ..... 101/41
5,715,508 A * 2/1998 Berkers et al. ..... 156/240
5,715,511 A * 2/1998 Aslam et al. ..... 101/35
5,824,388 A * 10/1998 Freund et al. ..... 101/35
5,846,632 A * 12/1998 Chen et al. ..... 428/195
6,146,805 A * 11/2000 Yoshimura et al. .. 101/DIG. 37
6,302,601 B1 * 10/2001 Hagstrom et al. ..... 101/35
6,332,680 B1 * 12/2001 Ozawa ..... 347/104
6,456,821 B2 * 9/2002 Onodera ..... 399/388

FOREIGN PATENT DOCUMENTS

JP 5-212857 8/1993
JP 05212857 A * 8/1993 ..... B41J/2/00
JP 11015171 A * 1/1999 ..... G03G/5/00
JP 11048530 A * 2/1999 ..... B41J/2/44
JP 11-167312 6/1999
JP 11224002 A * 8/1999 ..... G03G/15/16
JP 11-305560 11/1999
JP 11305564 A * 11/1999 ..... G03G/15/16

* cited by examiner

*Primary Examiner*—Robert Beatty
(74) *Attorney, Agent, or Firm*—Oblon, Spivak, McClelland, Maier & Neustadt, P.C.

(57) ABSTRACT

A printer or similar electrophotographic image forming apparatus for forming an image on an optical disk or similar synthetic resin sheet is disclosed. The apparatus of the present invention exerts a preselected pressure for each of image transfer and image fixation to thereby insure high quality images. Further, the apparatus matches the moving speed of the surface of a synthetic resin sheet and the peripheral speed of an image carrier or that of a fixing member. In addition, the apparatus protects the image carrier and fixing member from damage and prevents a parting agent from depositing on at least the image forming range of the image carrier.

50 Claims, 14 Drawing Sheets

IMAGE FORMING APPARATUS FOR SYNTHETIC RESIN SHEETS

BACKGROUND OF THE INVENTION

The present invention relates to a printer or similar electrophotographic image forming apparatus for forming images on optical disks or similar synthetic resin sheets. More particularly, the present invention relates to an image forming apparatus for forming a toner image on a synthetic resin sheet while conveying the sheet with a conveyor, and causing a fixing device to fix the toner image on the sheet with heat.

Today, an electrophotographic image forming apparatus capable of forming attractive full-color images on, e.g., paper sheets and OHP (OverHead Projector) forms are extensively used. Further, there has been proposed in various forms an image forming apparatus of the type forming an image on one surface of an optical disk, e.g., a CD (Compact Disk), a CD-RW (CD ReWritable), an LD (Laser Disk), a DVD (Digital Versatile Disk) or similar synthetic resin sheet, e.g., on the protection layer surface of a CD. It has been customary with this type of image forming apparatus to use offset printing or screen printing. However, the problem with offset printing or screen printing is that a master corresponding to a desired image must be produced by an extra process beforehand. As a result, the apparatus lacks efficiency when producing many kinds of images or increases cost when producing a small number of images.

In light of the above, Japanese Patent Laid-Open Publication No. 5-212857, for example, proposes an electrophotographic label printer for optical disks operable in the same manner as the traditional image forming apparatus for paper sheets or similar recording media. The label printer does not need masters and therefore the extra process for producing them.

Generally, in an electrophotographic image forming system, a toner image formed on an image carrier is transferred to the surface of a synthetic resin sheet and then fixed on the sheet by heat. Such image transfer and fixation are effected with the sheet being conveyed by a pallet or similar holding member. An optical disk, for example, is thicker than a paper sheet and circular.

We have already proposed an image forming apparatus in which the surface of a synthetic resin sheet is resiliently displaceable relative to the circumferential surface of a transfer drum or similar image carrier. The surface of the sheet overlaps the circumference of the image carrier at the axis side of the image carrier when held in an unstressed position. At an image transfer position, the surface of the sheet contacts the image carrier and is resiliently displaced thereby. The sheet then presses itself against the image carrier due to the resulting restoring force, so that a pressure for image transfer acts between the sheet and the image carrier.

Likewise, the surface of the sheet is resiliently displaceable relative to the circumferential surface of a heat roller or similar fixing member. The surface of the sheet overlaps the circumference of the fixing member at the axis side of the fixing member when held in an unstressed position. At a fixing position, the surface of the sheet contacts the fixing member and is resiliently displaced thereby. The sheet then presses itself against the fixing member due to the resulting restoring force, so that a pressure for fixation acts between the sheet and the fixing member.

The pressure for image transfer or the pressure for fixation therefore varies with the amount of overlap of the surface of the sheet and the circumference of the image carrier or that of the fixing member, respectively. It follows that a preselected amount of overlap must be set up at each of the image transfer position and fixing position. In practice, however, the preselected amount of overlap is sometimes not set up due to irregularity in the configuration of parts and in assembly. An amount of overlap greater than the preselected one would aggravate an impact on the contact of the sheet with the image carrier or the fixing member and would thereby damage the image carrier or the fixing member. An amount of overlap smaller than the preselected one would bring about defective image transfer or defective fixation.

The image carrier, for example, contacts the circular sheet in the direction perpendicular to the direction in which the sheet is conveyed (direction of sheet transfer hereinafter). Therefore, the width over which the image carrier contacts the sheet being conveyed varies every moment. So long as the image transfer pressure acting on the transfer drum is constant, it increases for a unit width with a decrease in the width of the sheet contacting the transfer drum and vice versa. The image transfer pressure so varying with the width of the sheet adversely effects image formation. For example, the image transfer pressure causes a toner image to be partly lost if short or causes a toner image to remain on the transfer drum due to reverse transfer if excessive. This is also true with the fixing pressure. Specifically, the fixing pressure causes a toner image to come off due to short fixation if short or renders gloss irregular if excessive.

A difference between the moving speed of the surface of the sheet and the peripheral speed of the transfer drum or that of the fixing roller also adversely influences image formation. For example, if the moving speed of the sheet and the peripheral speed of the transfer drum are different, then an image is expanded or contacted. If the moving sheet of the sheet and the peripheral speed of the fixing roller are different, then an image is rubbed or gloss becomes irregular.

Further, when the holding member or the sheet carried thereon contacts the transfer drum at the image transfer position, the end corner of the former is apt to abut against and damage the latter. This is also likely to occur at the fixing position where the fixing roller is positioned.

Silicone oil or similar parting agent is often coated on the fixing roller in order to prevent toner from depositing on the roller. The parting agent is apt to deposit on the holding member and then deposit on the transfer drum during the next image formation. The parting agent deposited on the transfer drum obstructs the transfer of the toner to the drum, resulting in defective images.

Technologies relating to the present invention are also disclosed in, e.g., Japanese Patent Laid-Open Publication Nos. 11-167312 and 11-305560.

SUMMARY OF THE INVENTION

It is therefore an object of the present invention to provide an image forming apparatus capable of electrophotographically forming an image on a synthetic resin sheet with a preselected image transfer pressure and a preselected fixing pressure, thereby insuring high quality images.

It is another object of the present invention to provide an image forming apparatus capable of forming high quality images by obviating a difference between the moving speed of a synthetic resin sheet and the peripheral speed of an image carrier or that of a fixing member.

It is yet another object of the present invention to provide an image forming apparatus capable of protecting an image carrier and a fixing member from damage.

It is a further object of the present invention to provide an image forming apparatus capable of preventing a parting agent from depositing on at least the image forming range of an image carrier.

An apparatus for forming an image on a synthetic resin sheet of the present invention includes an image carrier. A toner image forming device forms a toner image on the image carrier. A holding member holds the synthetic resin sheet on its surface that is resiliently displaceable when subjected to a force other than the weight of the sheet. A conveying device conveys the sheet held on the surface of the holding member along a preselected path. A transferring device transfers the toner image from the image carrier to the sheet being conveyed by the conveying device. A fixing device includes a fixing member for fixing the toner image transferred to the sheet. Rollers are mounted on at least one of the image carrier and fixing member at preselected positions for causing the surface of the holding member to be resiliently displaced such that the image surface of the sheet and the circumference of at least one of the image carrier and fixing member overlap each other by a preselected amount.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the image forming apparatus for synthetic resin sheets in accordance with the present invention will be described hereinafter.

First Embodiment

To better understand a first embodiment of the present invention, a prior art image forming apparatus for the above application will be described first. In the prior art apparatus, a synthetic resin sheet is supported such that its surface is resiliently displaceable when contacting an image transfer drum or similar image carrier or a heat roller or similar fixing member. Also, the sheet overlaps the circumference of the image carrier or that of the fixing member when held in an unstressed position with its surface being not displaced. Therefore, at an image transfer position, the surface of the sheet contacts the image carrier and is resiliently displaced thereby. The sheet then presses itself against the image carrier due to its resilient restoring force and exerts an image transfer pressure. It follows that the image transfer pressure or the fixing pressure varies with the amount of overlap of the surface of the sheet and the circumference of the image carrier. It is therefore necessary to set up a preselected amount of overlap at each of the image transfer position and fixing position.

Figure 1A:
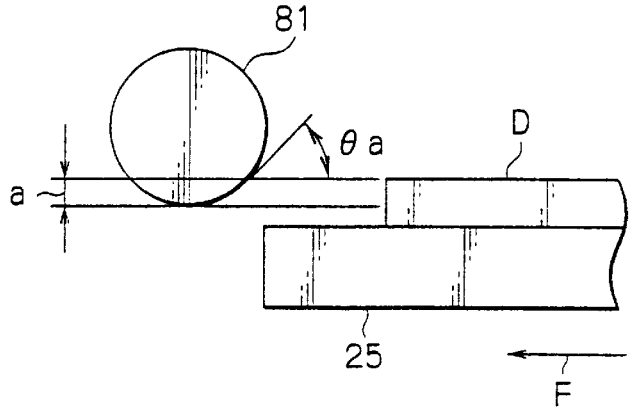
Fig. 1A PRIOR ART
FIGS. 1A through 1C are views showing different amounts of overlap between the surface of an optical disk and a fixing roller.

Specifically, FIG. 1A shows a specific condition wherein an optical disk D, which is a specific form of a synthetic resin sheet, overlaps a fixing roller 81 by a preselected amount a. As shown, the disk D is conveyed in a direction F and brought into contact with the fixing roller 81. In this case, an angle θa between a line tangential to the circumference of the fixing roller 81 and the surface of a protection layer formed on the disk D (collision angle hereinafter) is smaller than a collision angle that is likely to damage the roller 81. The disk D therefore does not damage the fixing roller 81. Further, the amount of overlap a guarantees a preselected fixing pressure and obviates defective fixation.

Figure 1B:
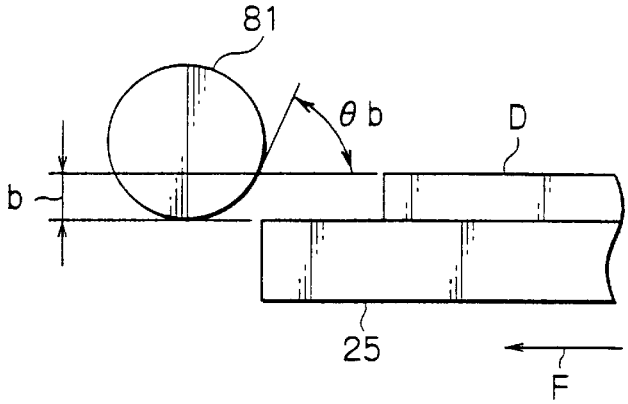
Fig. 1B PRIOR ART

FIG. 1B shows a specific condition wherein the disk D overlaps the circumference of the fixing roller 81 by an amount b greater than the preselected amount a. As shown, a collision angle θb between the line tangential to the circumference of the fixing roller 81 and the surface of the protection layer is greater than the collision angle that is likely to damage the roller 81.

Figure 1C:
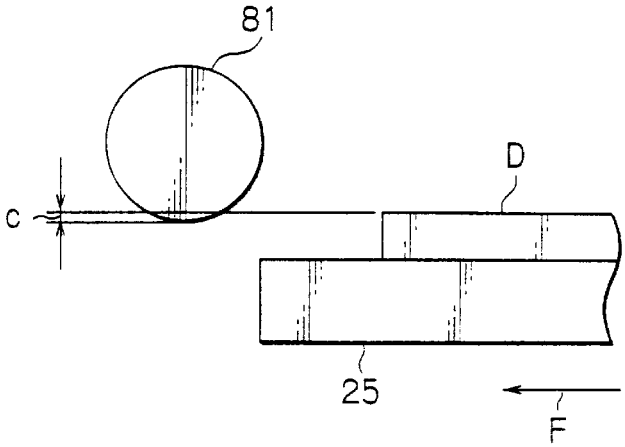
Fig. 1C PRIOR ART

FIG. 1C shows a specific condition wherein the disk D overlaps the circumference of the fixing roller 81 by an amount c smaller than the preselected amount a. In this condition, the fixing pressure to act between the fixing roller 81 and the disk D is apt to be short and result in defective fixation.

The illustrative embodiment is implemented as an electrophotographic printer applicable to a CD-R (CD Recordable) or similar optical disk, as will be described hereinafter.

Figure 2:
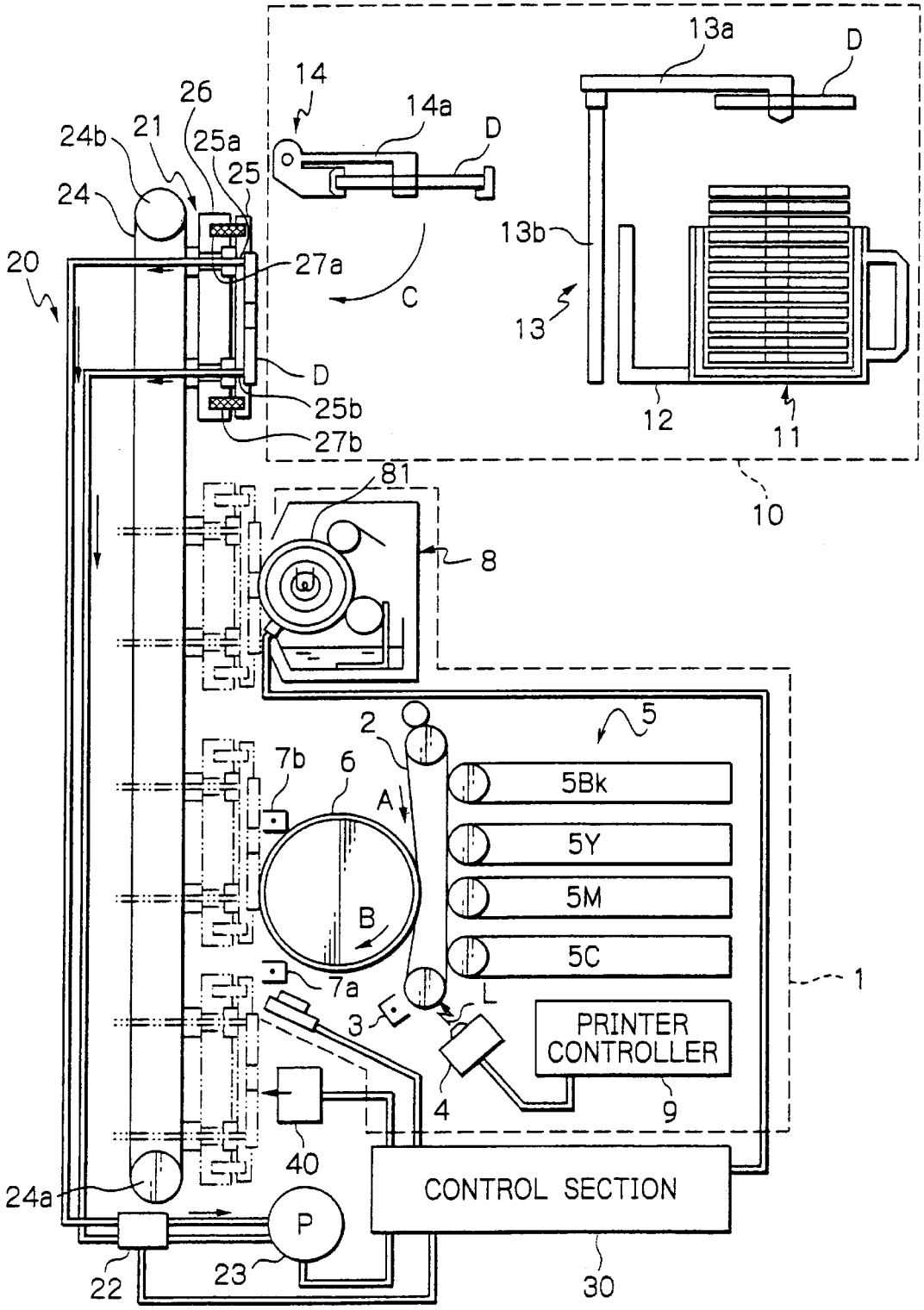
FIG. 2 is a view showing an image forming apparatus in accordance with the present invention and implemented as a printer.

Referring to FIG. 2, the electrophotographic printer is generally made up of an image forming section 1, a disk storage 10, a disk conveyor or disk conveying means 20, and a control section 30. The image forming section 1 forms an image on an optical disk or similar recording medium (disk hereinafter) D in accordance with image data received from a computer, not shown, which is connected to the printer. The disk storage 10 stores disks D not processed and disks D processed. The disk conveyor 20 conveys the disk D not processed from the disk storage 10 to a position where the image forming section 1 is expected to form an image. The disk conveyor 20 then conveys the disk D with a printed image from the image forming section 1 back to the disk storage 10. The control section or control means 30 controls the various sections of the printer.

The image forming section 1 includes a photoconductive belt 2, which is a specific form of an image carrier. Arranged around the belt 2 are a main charger or charging means 3, an optical writing unit or latent image forming means 4, four developing units or developing means SC (cyan), 5M (magenta), 5Y (yellow) and 5Bk (black), and an intermediate transfer drum 6. The main charger 3 uniformly charges the surface of the belt 2. The optical writing unit 4 electrostatically forms a latent image on the charged surface of the belt 2. The developing units 5C, 5M, 5Y and 5Bk respectively develop latent images sequentially formed on the belt 2 with a cyan, a magenta, a yellow and a black developer. The resulting toner images of different colors are sequentially transferred to the intermediate transfer drum or body 6 one above the other, completing a full-color image. Let this image transfer be referred to as primary image transfer.

The image forming section 1 additionally includes transfer chargers or charge depositing means 7*a* and 7*b* and a fixing unit of fixing means 8. The transfer chargers 7*a* and 7*b* transfer the full-color image from the intermediate transfer drum 6 to the disk D by charging the disk D. Let this image transfer be referred to as secondary image transfer. The fixing unit 8 fixes the full-color image transferred to the disk D.

The operation of the above printer will be described in relation to the formation of a full-color image. In response to a print signal received from the computer, the belt 2 starts running in a direction A shown in FIG. 2. At the same time, the main charger 3 starts uniformly charging the surface of the belt 2 to a preselected negative potential by corona discharge. The intermediate transfer drum 6 is rotated by the belt 3 at the same speed as the belt 3 in a direction B shown in FIG. 2. The optical writing unit 4 first scans the charged surface of the belt 2 with a laser beam L modulated in accordance with C image data, thereby forming a C latent image on the belt 2.

The developing unit 5C develops the C latent image with the C developer charged to negative polarity, thereby forming a C toner image on the belt 2. The C toner image is transferred from the belt 2 to the intermediate transfer drum 6 at a primary image transfer position where the belt 2 and drum 6 face each other. Specifically, a preselected electric field for primary image transfer is formed at the primary image transfer position in synchronism with the conveyance of the C toner image. As a result, the C toner image is electrostatically transferred to the drum 6. A belt cleaner, not shown, cleans the surface of the belt 2 after the primary image transfer.

The writing unit 4 forms an M latent image on the belt 2 in parallel with the primary transfer of the C toner image to the intermediate transfer drum 6. The developing unit 5M develops the M latent image with the M developer. The resulting M toner image is transferred from the belt 6 to the intermediate transfer drum 6 over the C toner image at the primary image transfer position. Subsequently, a Y and a Bk toner image are sequentially transferred to the intermediate transfer drum 6 in the same manner as the C and M toner images. Consequently, a full-color toner image is completed on the intermediate transfer drum 6.

The control section 30 controls the various operation timings of the image forming section 1, e.g., the writing timing of the writing unit 4 and the timing for applying a bias for development. While the above description has concentrated on a full-color image, the printer is, of course, capable of forming a monochromatic image in, e.g., black or an image in two or three colors.

The disk storage 10 includes a feed box or image support body storing member 11, a collection box or image support body storing member 12, and a first and a second storing mechanism 13 and 14. The feed box 11 and collection box 12 stores the disks D not processed and disks D processed, respectively. The first and second storing mechanisms 13 and 14 pickup one unprocessed disk D from the feed box 11 at a time and feed it to the disk conveyor 20. Also, the storing mechanisms 13 and 14 pick up the processed disk D conveyed by the disk conveyor 30 and store it in the collection box 11. The position where the second storing mechanism 14 feeds the disk D to the disk conveyor 20 or picks it up from the disk conveyor 20 (feed/collection position hereinafter) is aligned with the fixing position assigned to the fixing unit 8 and the secondary image transfer position.

More specifically, a plurality of disks D are stacked in the box 11. A first robot arm 13*a* included in the first storing mechanism 13 picks up the top disk, then makes half a rotation about a shaft 13*b*, and then hands it over to a second robot arm 14*a* included in the second storing mechanism 13. The second robot arm 14*a* angularly moves downward in a direction C shown in FIG. 2 to thereby set the disk D in the disk conveyor 20.

The disk conveyor 20 includes a disk holding mechanism 21. The disk holding mechanism 21 includes a table 25 having a support surface that is formed with a pair of suction ports 25*a* and 25*b*. The suction ports 25*a* and 25*b* are fluidly communicated to an air pump 23 via a pressure sensor 22. The air pump 23 sucks air via the suction ports 25*a* and 25*b*, causing the table 25 to hold the disk D. At this instant, the disk D has a recording surface contacting the support surface of the table 25 and a protection layer surface being exposed. The exposed surface of the disk D contacting the table 25 will be referred to as a front surface hereinafter. A base plate 26 supports the table 25. A pair of springs 27*a* and 27*b* resiliently maintain the support surface of the table 25 displaceable. With this configuration, the disk holding mechanism 21 conveys the disk D while resiliently maintaining the protection layer of the disk D displaceable relative to the fixing roller 81.

The disk conveyor 20 further includes a belt 24 to which the table 25 is affixed. A belt drive mechanism, not shown, drives the belt 24 such that the disk holding mechanism 21 and therefore the table 25 moves back and forth in the up-and-down direction as viewed in FIG. 2. The belt 24 and belt drive mechanism constitute belt moving means. The position of the table 25 indicated by a solid line in FIG. 2 will be referred to as a home position hereinafter.

Figure 3A:
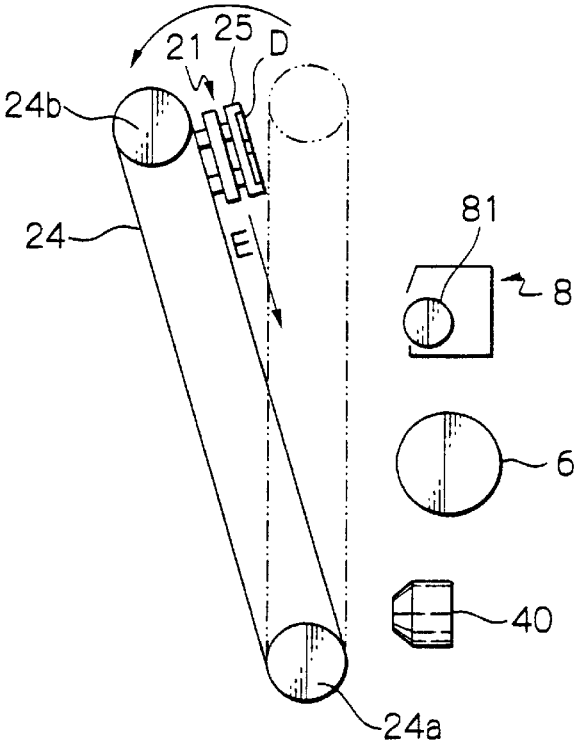
FIGS. 3A and 3B are views demonstrating how a conveyor included in the printer conveys an optical disk.
Figure 3B:
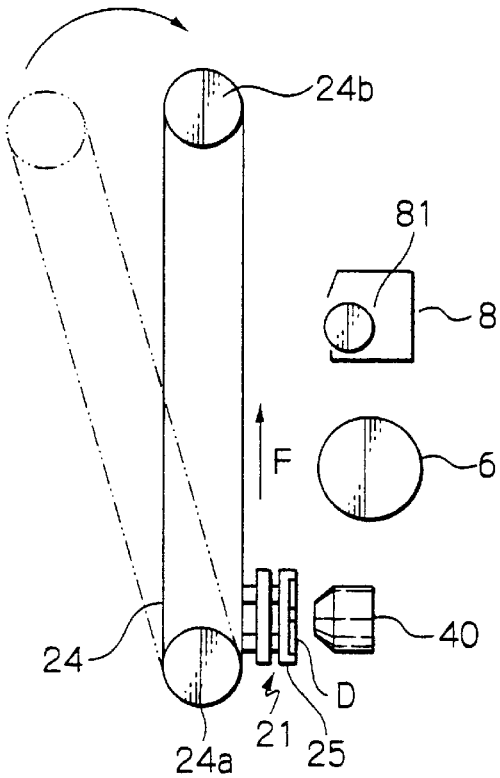

Reference will be made to FIGS. 3A and 3B for describing how the disk conveyor 20 conveys the disk D. As shown, the belt 24 is passed over a lower roller 24*a* and an upper roller 24*b*. A moving mechanism, not shown, causes the belt 24 to angularly move about the lower roller 24*a* between a feed position and a return position, which are respectively indicated by a solid line in FIG. 3A and a solid line in FIGS. 3B. After the second storing mechanism 14 has set the disk D on the table 25, the belt 24 is moved to the feed position. The belt drive mechanism causes the belt 24 and therefore the table 25 carrying the disk D to move toward the lower roller 24*a*, as indicated by an arrow E. At this instant, the belt 24 conveys the disk along a path that does not adjoin or contact a heat roller or fixing member 81, which is included in the fixing unit 8, or the intermediate transfer drum 6.

After the table has been conveyed to the lower roller 24*a*, the belt 24 is moved to the return position. Subsequently, the belt 24 conveys the table 25 backward toward the upper roller 24*b*, as indicated by an arrow F. At this instant, the previously mentioned front surface of the disk D adjoins or contacts the intermediate transfer drum 6 at the secondary image transfer position. The front surface of the disk D then adjoins or contacts the heat roller 81 at the fixing position. A front/rear distinguishing device 40 is located to face the disk D after the belt 24 has been shifted to the return position. Let the position where the front/rear distinguishing device 40 faces the disk D be referred to as a distinguishing position. The front/rear distinguishing device 40 determines whether or not the protection layer surface of the disk D is the front surface.

Assume that the protection layer surface of the disk D is the front surface (normal position), as determined by the front/rear distinguishing device 40. Then, the control section 30 causes the table 25 to move via the belt 24 in synchronism with the arrival of the leading edge of the full-color image formed on the intermediate transfer drum 6 at the secondary image transfer position. The chargers 7*a* and 78*b* are respectively positioned upstream and downstream of the secondary image transfer position in the direction of disk conveyance. The chargers 7*a* and 7*b* charge the front surface or protection layer surface of the disk D to positive polarity. As a result, an electric field for secondary image transfer is formed between the disk D and the intermediate transfer drum 6 at the secondary image transfer position. The electric field causes the full-color toner image to electrostatically move from the intermediate transfer drum 6 to the front surface of the disk D.

After the secondary image transfer to the disk D, the belt 24 conveys the table 25 and therefore the disk D to the fixing position where the heat roller 81 is positioned. The heat roller 81 contacts the front surface of the disk D for thereby fixing the toner image on the disk D with heat. Subsequently, the belt 24 conveys the disk D to the home position mentioned earlier. The first and second storing mechanisms 13 and 14 cooperate to pick up the disk D from the table 25 and collect it in the collection box 12.

The above description has concentrated on a printer of the type sequentially effecting primary image transfer and secondary image transfer. Alternatively, the image forming section 1 may be implemented by the configuration of a conventional image forming section dealing with, e.g., paper sheets.

Figure 4:
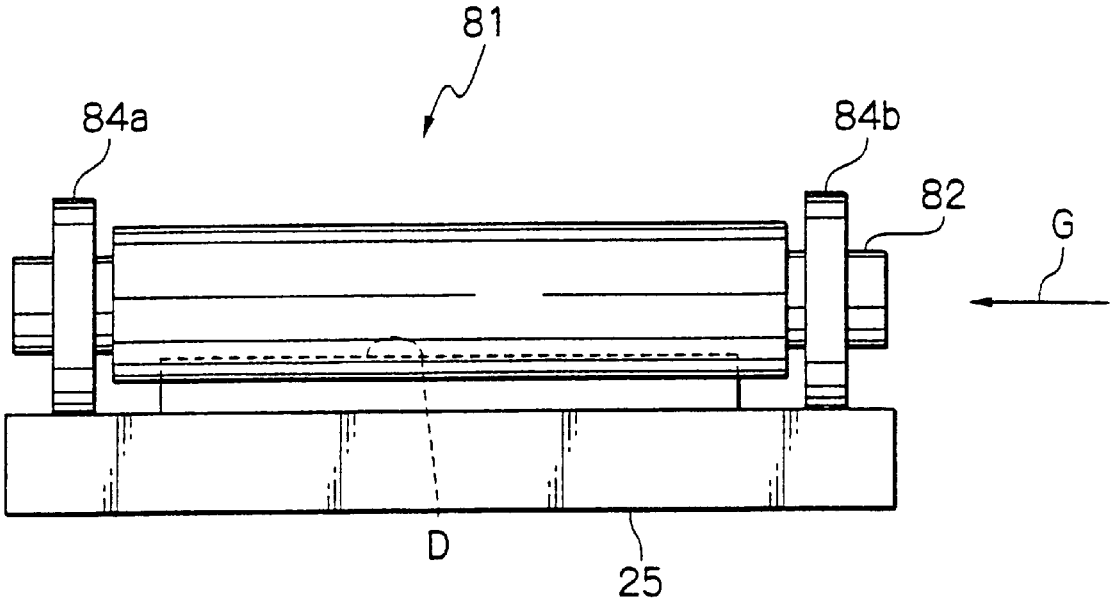
FIG. 4 is a view as seen from the downstream side in a direction of sheet conveyance, showing a fixing position included in a first embodiment of the present invention.
Figure 5:
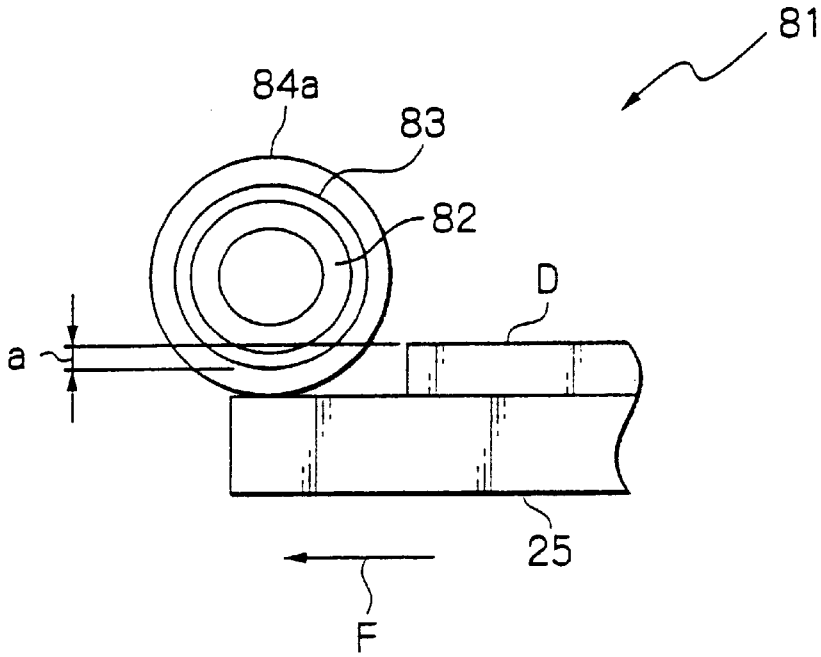
FIG. 5 is a side elevation as seen in a direction G shown in FIG. 4, showing a positioning roller in operation.

Arrangements unique to the illustrative embodiment will be described with reference to FIGS. 4 and 5. FIG. 4 shows the fixing position as seen from the downstream side in the direction of disk conveyance F. FIG. 5 is a side elevation as seen in a direction G shown in FIG. 4.

As shown in FIG. 5, the heat roller 81 is made up of a core 82 formed of metal and an elastic rubber layer 83 covering the core 82. As shown in FIG. 4, a pair of positioning rollers 84*a* and 84*b* are mounted on opposite ends of the core 82 in order to adjust the overlap of the heat roller 81 and disk D. As shown in FIG. 5, the outside diameter of the positioning rollers 84*a* and 84*b* is selected such that when the rollers 84*a* and 84*b* contact the support surface of the table 25, the circumference of the rubber layer 83 and disk D overlap each other by an adequate amount a.

The springs 27*a* and 27*b*, FIG. 2, support the table 25 such that the support surface of the table 25 is resiliently displaceable. Further, assume a position where the support surface of the table 25 supporting the disk D is not displaced by extraneous forces other than the weight of the disk D. Then, the base plate 26, FIG. 2, supports the table 25 such that at the above position the support surface is located at the axis side of the positioning rollers 84*a* and 84*b* with respect to the circumferences of the rollers 84 and 84*b*.

The support surface of the table 25 conveying the disk D in the direction F first contacts the positioning rollers 84*a* and 84*b* and is forced downward thereby. As a result, the adequate amount of overlap a is set up between the rubber layer 83 of the heat roller 81 and the disk D. Subsequently, the rubber layer 83 and disk D contact each other with the adequate overlap a. In this manner, the outside diameter of the positioning rollers 84*a* and 84*b* guarantees the adequate overlap a between the disk D and the heat roller 81 and prevents it from noticeably varying. An excessively great overlap or an excessively small overlap would damage the rubber layer 83 or would bring about defective fixation due to short pressure, respectively.

The advantage of the illustrative embodiment described above is also true with the secondary image transfer position where the disk D and transfer drum 6 contact each other, as shown in FIG. 2.

As shown in FIG. 5, when the disk being conveyed in the direction F contacts the rubber layer 83 of the heat roller 81, the rubber layer 83 elastically deforms to allow fixation to occur under the adequate overlap a. At this instant, assume that the peripheral speed of the rubber layer 83 and the moving speed of the disk D are different from each other. Then, the circumference of the rubber layer 83 and the protection layer surface of the disk D are apt to slip on each other and lower image quality. Therefore, the above two speeds should preferably be the same as each other. In the illustrative embodiment, the frictional force acting between the positioning rollers 84*a* and 84*b* and the table 25 is increased, compared to a case wherein the rollers 84*a* and 84*b* and table 25 both are formed of metal. This successfully matches the peripheral speed of the rubber layer 83 and the moving speed of the disk D.

More specifically, in FIG. 4, the circumferences of the positioning rollers 84*a* and 84*b* each are covered with a high friction member not shown. The high friction member may be implemented by sandpaper or a rubber member having a roughened surface by way of example. Such high friction members allow an intense frictional force to act between the positioning rollers 84*a* and 84*b* and the table 25 than when the rollers 84*a* and 84*b* have, e.g., metallic surfaces. Consequently, even when the peripheral speed of the positioning rollers 84*a* and 84*b* and the moving speed of the table 25 differ from each other, one of them can follow the other. That is, the peripheral speed of the rubber layer 83 and the moving speed of the protection layer surface of the disk D substantially coincide because the positioning rollers 84*a* and 84*b* and rubber layer 83 are coaxial and rotate together. This obviates the previously mentioned slip that would make an image and gloss irregular. In the illustrative embodiment, the high friction members are provided on the positioning rollers 84*a* and 84*b*. Alternatively, the high friction members may be provided on the portions of the support surface of the table 25 expected to contact the positioning rollers 84*a* and 84*b* or on both of the table 25 and rollers 84*a* and 84*b*.

The increased frictional force described above is similarly applied to the secondary image transfer position where the transfer drum 6 and disk D contact each other.

As stated above, the illustrative embodiment allows the protection layer surface of the disk D and the circumference of the heat roller 81 or that of the transfer drum 6 to overlap each other by a preselected amount. The heat roller 81 and transfer drum 6 are therefore free from damage. Further, the protection layer surface of the disk D moves at substantially the same speed as the circumference of the heat roller 81 or that of the transfer drum 6, insuring desirable fixation and secondary image transfer.

The heat roller 81 may, of course, be replaced with a fixing belt. Likewise, the transfer drum 6 playing the role of an image carrier may be replaced with a belt.

First Modification

Figure 6:
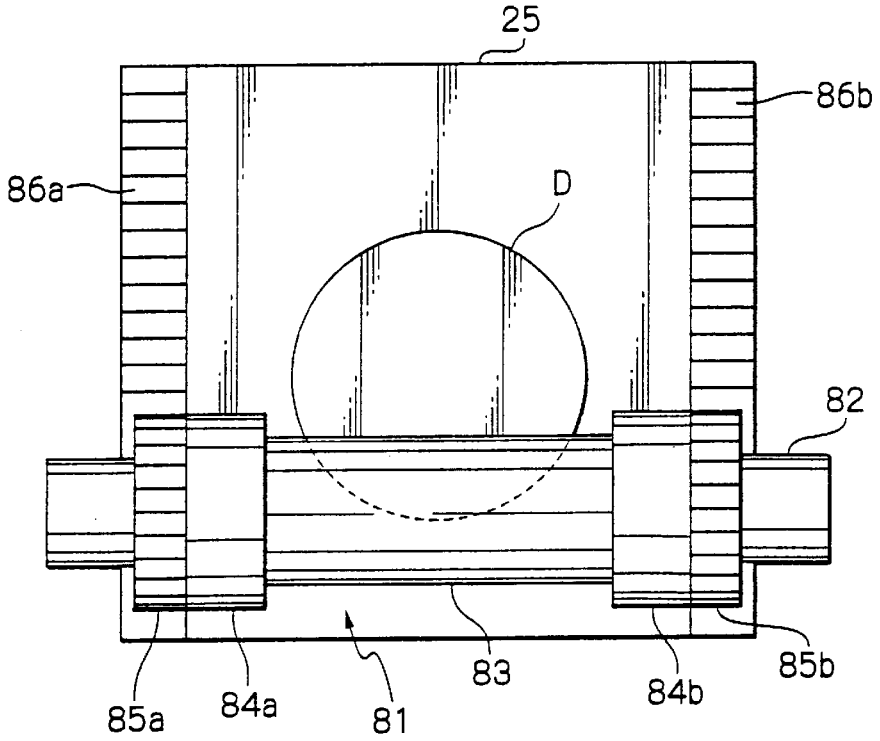
FIG. 6 is a view as seen from a positioning roller side, showing a fixing position included in the first embodiment.

Reference will be made to FIG. 6 for describing a modification of the illustrative embodiment. FIG. 6 shows the fixing position as seen from the heat roller side. As shown, a pair of gears 85*a* and 85*b* for fixation speed synchronization are mounted on the core 82 of the heat roller 81 outside of the positioning rollers 84*a* and 84*b*, respectively. Rack gears 86*a* and 86*b* are formed on the support surface of the table 25 at positions where they are capable of meshing with the gears 85*a* and 85*b*. When the table 25 conveys the disk D, the rack gears 86*a* and 86*b* mesh with the gears 85*a* and 85*b*, respectively. As a result, the peripheral speed of the rubber layer 83 of the heat roller 81 and the disk conveying speed coincide with each other. This is also successful to obviate slip between the circumference of the rubber layer 83 and the protection layer surface of the disk D and therefore to protect image quality from deterioration. The gear scheme is a substitute for the high friction member scheme of the illustrative embodiment.

The gear scheme described above is similarly applied to the secondary image transfer position where the disk D and transfer drum 6 contact each other. Specifically, gears for transfer speed synchronization are mounted on the core of the drum 6 outside of a pair of positioning rollers although not shown specifically. When the gears respectively mesh with the rack gears 86*a* and 86*b* formed on the table 26, the peripheral speed of the transfer drum 6 and the disk conveying speed coincide with each other. This protects an image from expansion or contraction.

Second Embodiment

Figure 7:
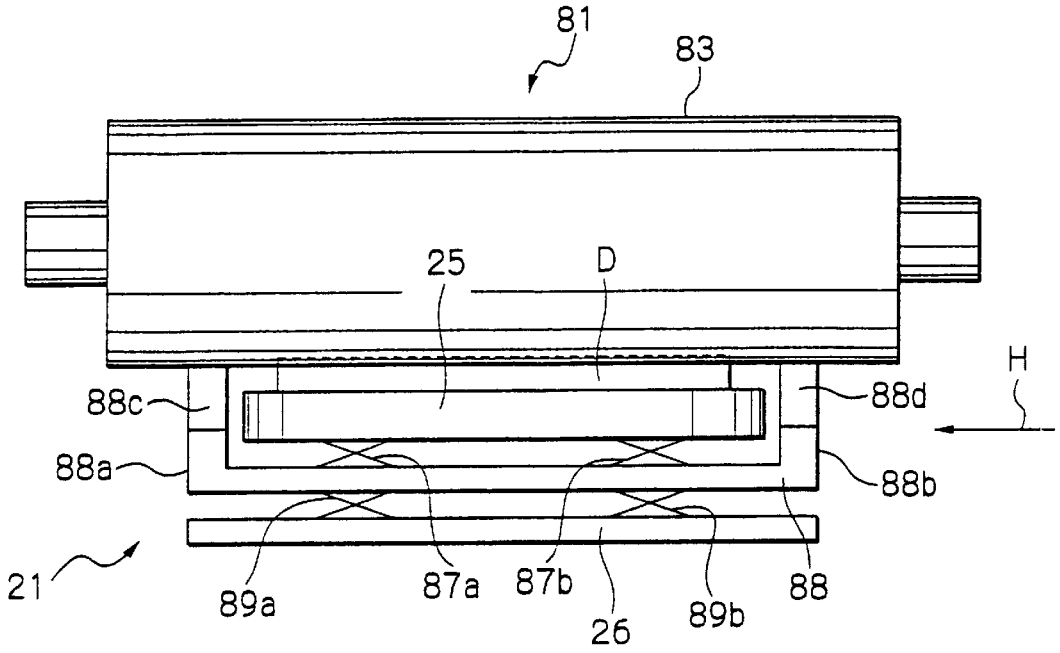
FIG. 7 is a view as seen from the downstream side, showing a disk holding mechanism included in a second embodiment of the present invention.
Figure 8:
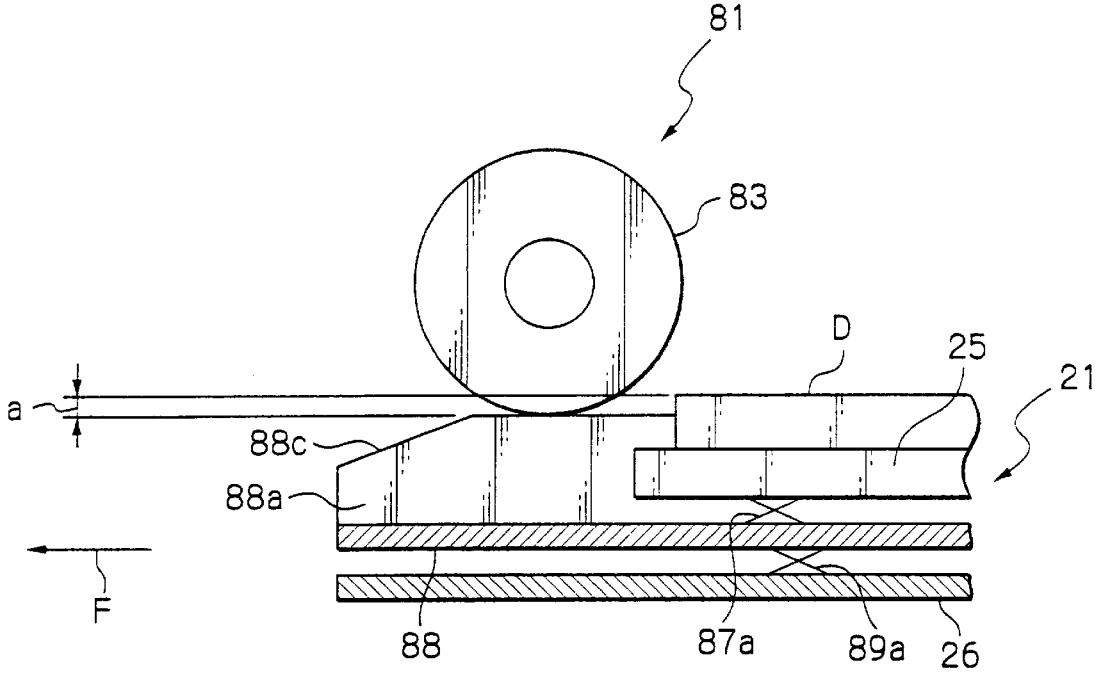
FIG. 8 is a side elevation as seen in a direction H shown in FIG. 7.

An alternative embodiment of the present invention will be described with reference to FIGS. 7 and 8. FIG. 7 shows the disk holding mechanism 21 as seen from the downstream side in the direction of disk conveyance F. FIG. 8 is a view as seen in a direction H shown in FIG. 7. As shown, the disk holding mechanism 21 includes a pair of first springs 87*a* and 87*b*, a support plate 88 and a pair of second springs 89*a* and 89*b* in addition to the table 25 and base plate 26. A pair of lugs 88*a* and 88*b* protrude from the right and left edges of the support plate 88 in the direction perpendicular to the direction of disk conveyance. As shown in FIG. 8, the lugs 88*a* and 88*b* respectively include slants 88*c* and 88*d* each rising from the downstream side toward the upstream side in the direction F.

The first springs 87*a* and 87*b* allow the support plate 88 to resiliently support the table 25 such that the support surface of the table 25 is displaceable relative to the circumference of the rubber layer 83 of the heat roller 81. The second springs 89*a* and 89*b* allow the base plate 26 to resiliently support the table 25 such that the support surface and the tops of the lugs 88*a* and 88*b* are displaceable relative to the circumference of the rubber layer 83. Further, assume a position where the tops of the lugs 88*a* and 88*b* are not displaced by extraneous forces other than the weight of the table 25, disk D and springs 87*a* and 87*b*. Then, the base plate 26 supports the support plate 88 such that at the above position the support plate 88 is located at the axis side of the heat roller 81 with respect to the circumference of the rubber layer 83.

As shown in FIG. 8, when the disk holding mechanism 21 is conveyed in the direction F, the slant 88*c* (and slant 88*d*) contacts the rubber layer 83 of the heat roller 81 first. At this instant, the collision angle between a line tangential to the rubber layer 83 and the slant 88*c* is smaller than when the slant 88*c* is absent. This successfully reduces an impact when the slant 88*c* contacts the rubber layer 83.

Subsequently, the top of the lug 88*a* (and lug 88*b*) contiguous with the slant 88*c* contacts the rubber layer 83. As a result, the support plate 88 is forced downward with the second springs 89*a* and 89*b* being compressed, so that the preselected overlap a is set up between the circumference of the rubber layer 83 and the disk D. As the disk holding mechanism 21 is further conveyed in the direction F, the disk D contact the rubber layer 83 while overlapping it by the adequate amount a.

High friction members may be provided on the tops of the lugs 88*a* and 88*b*. The high friction members allow a more intense frictional force to act between the lugs 88*a* and 88*b* and the rubber layer 83 than when the lugs 88*a* and 88*b* have, e.g., metallic tops. Consequently, even when the peripheral speed of the rubber layer 83 and the moving speed of the lugs 88*a* and 88*b* differ from each other, one of them can follow the other. That is, the peripheral speed of the rubber layer 83 and the moving speed of the protection layer surface of the disk D substantially coincide because the table 25 holding the disk D is supported by the support plate 88 via the first springs 87*a* and 87*b*. This obviates slip otherwise occurring between the rubber layer 83 and the disk and making an image and gloss irregular. In the illustrative embodiment, the high friction members are provided on the tops of the lugs 88*a* and 88*b*. Alternatively, the high friction members may be provided on the portions of the circumference of the rubber layer 83 expected to contact the lugs 88*a* and 88*b* or on both of the rubber layer 83 and lugs 88*a* and 88*b*.

Further, a pair of rack gears may be positioned outside of the lugs 88*a* and 88*b*, in which case a pair of gears for synchronization will be mounted on the core 82 of the transfer roller 81. This gear scheme also has the advantage stated earlier.

The configuration shown in FIGS. 7 and 8 is also applicable to the secondary image transfer position where the disk D and transfer drum 6 contact each other.

As stated above, the illustrative embodiment allows the protection layer surface of the disk D and the circumference of the heat roller 81 or that of the transfer drum 6 to overlap each other by a preselected amount. The heat roller 81 and transfer drum 6 are therefore free from damage. Further, the upward slants 88*c* and 88*d* contact the transfer drum 6 first, reducing an impact. In addition, the protection layer surface of the disk D moves at substantially the same speed as the circumference of the heat roller 81 or that of the transfer drum 6, insuring desirable fixation and secondary image transfer.

Second Modification

Figure 9:
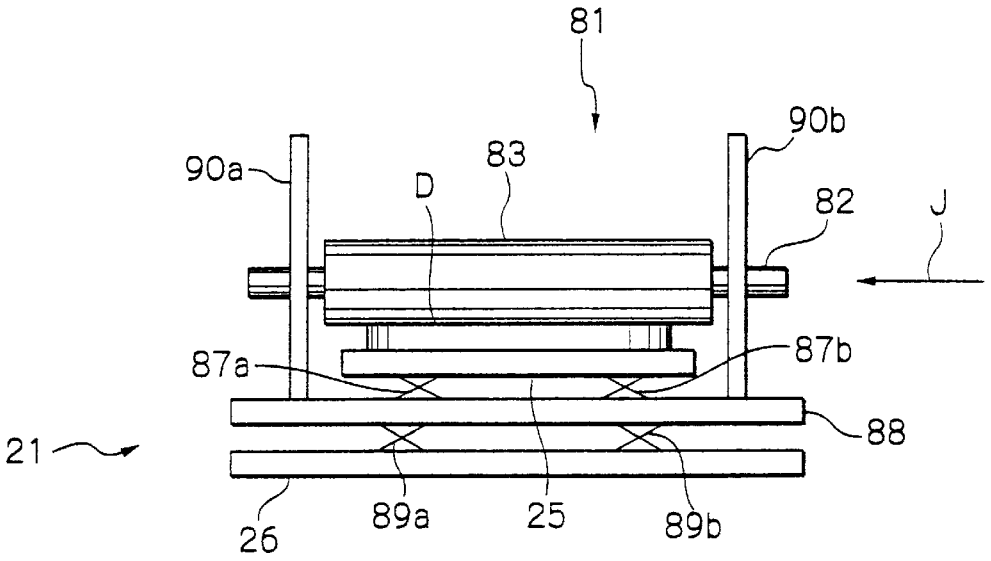
FIG. 9 is a view as seen from the downstream side, showing a modification of the second embodiment.
Figure 10:
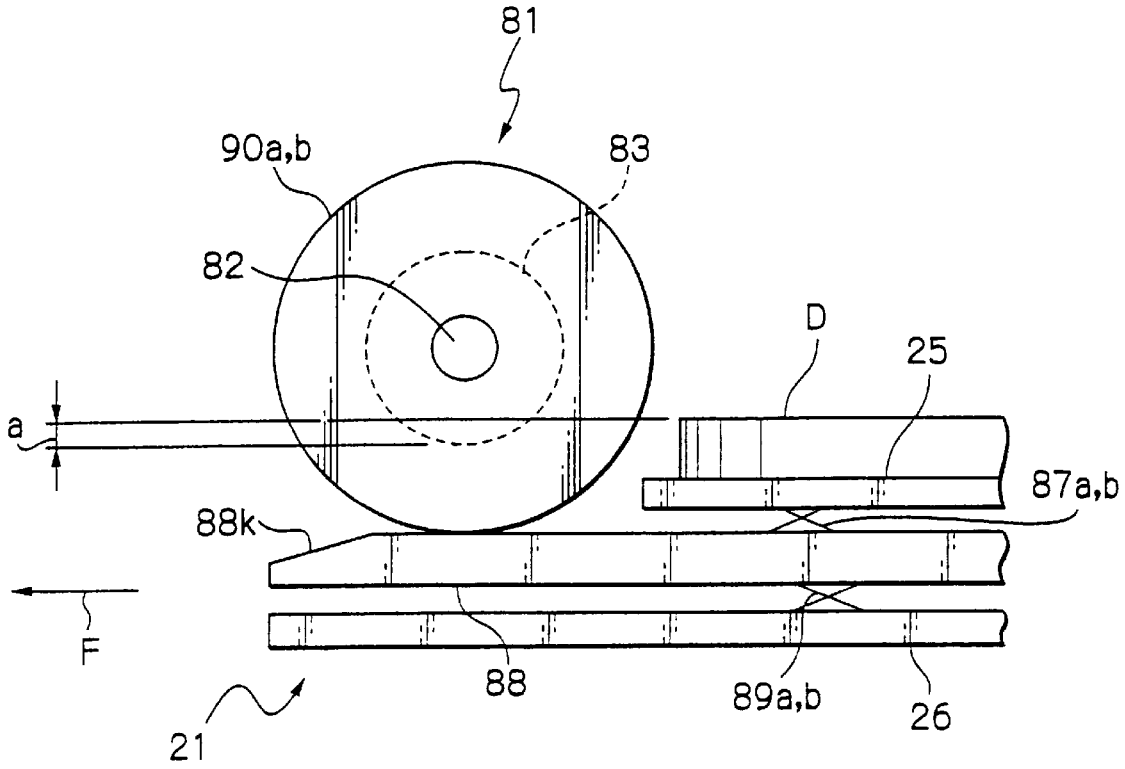
FIG. 10 is a side elevation as seen in a direction H shown in FIG. 9.

FIGS. 9 and 10 show a modification of the second embodiment. FIG. 9 shows the disk holding mechanism 21 as seen from the downstream side in the direction of disk conveyance F. FIG. 10 is a view as seen in a direction J shown in FIG. 9. As shown, a pair of positioning rollers 90*a* and 90*b* are mounted on opposite ends of the core 82 of the heat roller 81 and substituted for the lugs 88*a* and 88*b* included in the support plate 88. Assume a position where the top of the support plate 88 is not displaced by extraneous forces other than the weight of the table 25, disk D and first springs 87*a* and 87*b*. Then, the base plate 26 supports the support plate 88 such that the top of the support plate 88 is located at the axis side of the heat roller 81 with respect to the circumferences of the positioning rollers 90*a* and 190*b*. In addition, as shown in FIG. 10, the support plate 88 is formed with a slant 88*k* at its downstream end in the direction of disk conveyance. The slant 88*k* rises from the downstream side toward the upstream side.

As shown in FIG. 10, the disk holding mechanism 21 is conveyed in the direction F, the slant 88*k* contacts the positioning rollers 90*a* and 90*b* first. At this instant, the collision angle between a line tangential to each positioning roller 90*a* or 90*b* and the associated slant 88*k* is smaller than when the slant is absent. This successfully reduces an impact at the time of contact. The top of the support plate 88 contacts the circumferences of the positioning rollers 90*a* and 90*b*. As a result, the support plate 88 is forced downward with the second springs 89*a* and 89*b* being compressed, so that the preselected overlap a is set up between the circumference of the rubber layer 83 and the disk D. As the disk holding mechanism 21 is further conveyed in the direction F, the disk D contacts the rubber layer 83 while overlapping it by the adequate amount a. In this manner, the outside diameter of the positioning rollers 90*a* and 90*b* guarantees the adequate overlap a of the disk D and heat roller 81 and prevents it from noticeably varying. An excessively great overlap or an excessively small overlap would damage the rubber layer 83 or would bring about defective fixation due to short pressure, respectively.

High friction members may cover the positioning rollers 90*a* and 90*b*. The high friction members allow an intense frictional force to act between the rollers 90*a* and 90*b* and the support plate 88 than when the positioning rollers 90*a* and 90*b* have, e.g., metallic surfaces. Consequently, even when the peripheral speed of the positioning rollers 90*a* and 90*b* and the moving speed of the top of the support plate 88 differ from each other, one of them can follow the other. That is, the peripheral speed of the rubber layer 83 and the moving speed of the protection layer surface of the disk D substantially coincide because the table 25 holding the disk D is supported by the support plate 88 via the first springs 87*a* and 87*b*. This obviates slip otherwise occurring between the rubber layer 83 and the disk D and making an image and gloss irregular.

In the modification, the high friction members are provided on the positioning rollers 90*a* and 90*b*. Alternatively, the high friction members may be provided on the portions of the top of the support plate 88 expected to contact the positioning rollers 90*a* and 90*b* or on both of the rollers 90*a* and 90*b* and support plate 88.

Further, a pair of gears may be positioned outside of the positioning rollers 90*a* and 90*b*, in which case a pair of rack gears for synchronization will be formed on the top of the support table 88. This gear scheme also has the advantage stated earlier.

Third Embodiment

This embodiment is essentially similar to the embodiments and modifications thereof shown in FIGS. 2, 3A and 3B as to the configuration and operation of the printer. The following description will therefore concentrate on arrangements unique to the illustrative embodiment.

Figure 11A:
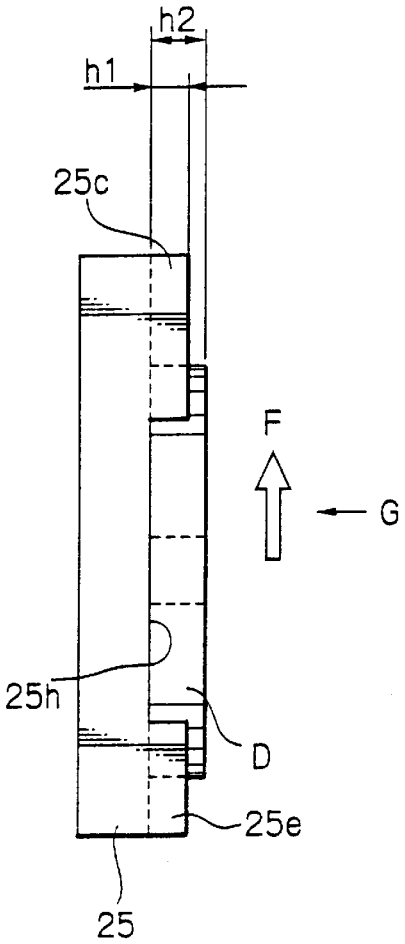
FIG. 11A is a side elevation showing a table included in a third embodiment of the present invention.
Figure 11B:
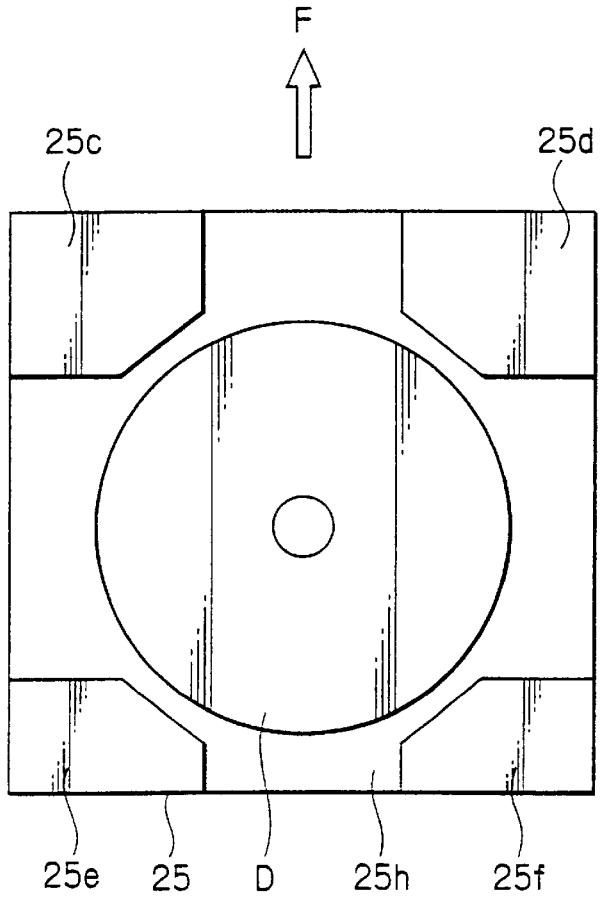
FIG. 11B is a view as seen in a direction G shown in FIG. 11A.

FIG. 11A shows the table 25 of the disk holding mechanism 21 that characterizes the illustrative embodiment. FIG. 11B is a view as seen in a direction G shown in FIG. 11A. As shown in FIG. 11B, the table 25 has a substantially square contour. Two lugs 25*c* and 25*d* protrude from the right and left corners of the table 25 at the downstream side in the direction F, and each is higher in level than the support surface labeled 25*h*. Other two lugs 25*e* and 25*f* protrude from the right and left corners of the table 25 at the upstream side in the direction F, and each is higher than the disk support surface 25*h*.

Figure 12:
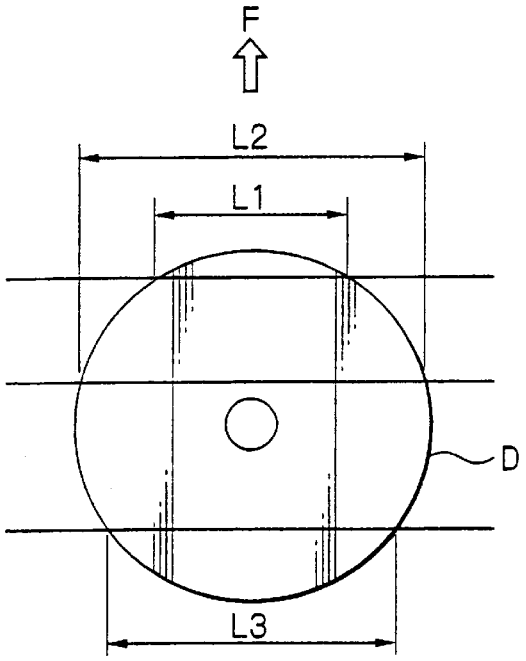
FIG. 12 is a view showing the varying width of the optical disk in the direction perpendicular to the direction of disk conveyance.

FIG. 12 shows the dimensions, or widths, of the circular disk D in the direction perpendicular to the direction F. As shown, the disk D has a width $L_1$ at its downstream side that is smaller than a width $L_2$ at the center. Also, the disk has a width $L_3$ at the upstream side that is smaller than the width $L_2$ at the center. At the secondary image transfer position shown in FIG. 2, for example, the disk D held by the table 25 is brought into contact with the transfer drum 6. At this position, a preselected pressure acts on the disk D so as to transfer a toner image from the transfer drum 6 to the protection layer surface of the disk D. Therefore, as the width over which the disk D contacts the transfer drum 6 sequentially varies, the pressure to act on the disk D for a unit width varies. More specifically, the pressure is higher at the downstream side and upstream side of the disk D than at the center of the same. Such an irregular pressure distribution causes the toner image to be partly lost or causes it to remain on the transfer drum 6 due to reverse transfer, as discussed previously. Likewise, at the fixing position, a fixing pressure is irregular over the entire protection layer surface of the disk D and causes the toner image to come off if it is short or makes gloss irregular if it is excessive. Preferably, therefore, the image transfer pressure and the fixing pressure each should be uniform over the entire protection layer surface of the disk D.

In the illustrative embodiment, the four lugs 25*c* through 25*f* protruding from the table 25 contact the drum 6, which has the elastic surface. Therefore, in FIG. 11B, the transfer drum 6 contacts the disk D at the time of image transfer. At the same time, the elastic surface of the transfer drum 6 deforms and contacts the lugs 25*c* through 25*f*. As a result, the image transfer pressure is scattered. This prevents the pressure from becoming excessive at the downstream side and upstream side of the disk D or becoming short at the center of the disk D.

Further, as shown in FIG. 11B, the lugs 25*c* and 25*d* positioned at the downstream side in the direction F each decrease in width toward the upstream side, i.e., the center of the disk D in the direction F. In this condition, when the protection layer surface of the disk moves, the drum 6 and the disk D and lugs 25*c* and 25*d* contact each other over substantially the same width, causing a substantially uniform pressure to act on the protection layer surface. On the other hand, the lugs 25*e* and 25*f* at the downstream side in the direction F each increase in width toward the upstream side. Therefore, when the protection layer surface of the disk moves, the drum 6 and the disk D and lugs 25*e* and 25*f* contact each other over substantially the same width, causing a substantially uniform pressure to act on the protection layer.

As stated above, the pressure for image transfer is substantially uniform over the entire protection surface of the disk D and obviates the omission of a toner image and reverse transfer, thereby insuring desirable secondary transfer. In addition, the pressure for fixation is substantially uniform over the entire protection surface of the disk D and obviates the come-off of a toner image and irregular gloss.

While the lugs 25*c* through 25*f* are shown in FIG. 11A as being slightly lower in level than the protection layer surface of the disk D, such a configuration is only illustrative. The crux is that the lugs 25*c* through 25*f* each have a height h, as measured from the support surface 25*h*, lying in the range of ±1 mm with respect to the height $h_2$ of the protection layer surface of the disk D. If the height h, is lower than the protection layer surface by more than 1 mm, then elastic layer of the transfer drum 6 or that of the heat roller 81 fails to contact the lugs 25*c* through 25*f* despite their deformation and therefore to receive pressure. If the height $h_1$ is higher than the protection layer surface by more than 1 mm, then the surface of the transfer drum 6 or that of the heat roller 81 does not contact the disk D at all despite their deformation, practically failing to execute image transfer or fixation.

If desired, elastic members may be adhered to the surfaces of the lugs 25*c* through 25*f* expected to contact, e.g., the transfer drum 6. In such a case, the elastic members will deform and adequately distribute the pressure to the disk D and lugs 25*c* through 25*f*, further enhancing image quality. Alternatively, the lugs 25*c* through 25*f* themselves may be implemented as elastic members.

Figure 13A:
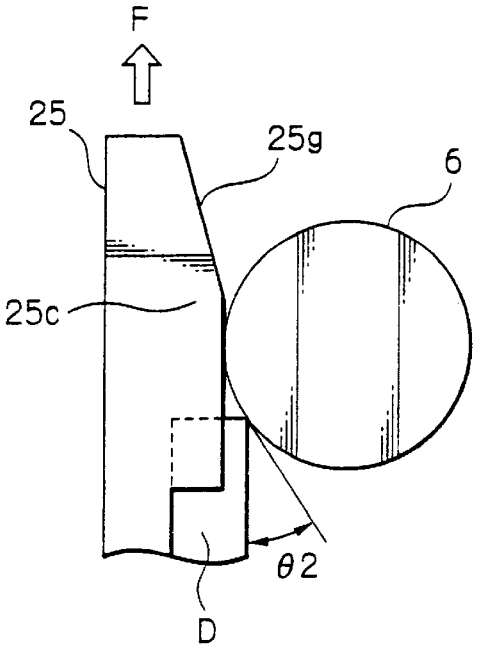
FIG. 13A is a fragmentary view showing the downstream portion of the table.
Figure 13B:
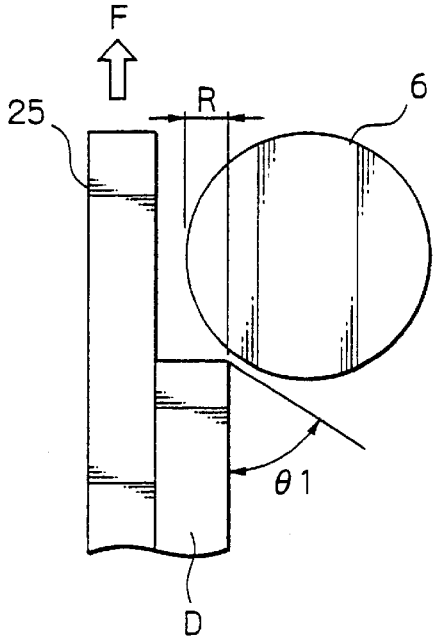
FIG. 13B is a view similar to FIG. 13A, showing a table lacking lugs.

As shown in FIG. 13B, the transfer drum 6 is so positioned as to overlap the disk D by an amount R, thereby exerting pressure for image transfer on the disk D. When the disk D arrives at the secondary image transfer position, the amount of overlap R varies in a certain range due to irregularity in the configuration of the individual part and in assembling accuracy. When the amount of overlap is greater than the amount R, the collision angle, labeled $\theta_1$, between the transfer drum 6 and the disk D increases and is apt to damage the drum 6.

In light of the above, as shown in FIG. 11B, the lugs 25*c* and 25*d* are formed on the table 25 at the downstream side in the direction F. As shown in FIG. 11A, when the table 25 enters the secondary image transfer position, the lug 25*c* (and lug 25*d*) contacts the transfer drum 6 first and compresses the springs 27*a* and 27*b*, FIG. 2, to thereby shift the table 25 to the left. The disk D therefore contacts the transfer drum 6 only after the amount of overlap has been adjusted. It is therefore possible to reduce the collision angle, labeled $\theta_2$ to a preselected angle so as to protect the transfer drum 6 from damage. Further, the lug 25*c* has a slant 25*g* at its end that rises from the downstream side toward the upstream side. This is also true with the other lug 25*d*. The transfer drum 6 contacts the slant 25*g* first and is therefore protected from damage. In addition, the slant 25*g* reduces an impact when the table 25 and transfer drum 6 contact each other.

The configuration shown in FIG. 13A is similarly applicable to the fixing position where the table 25 and disk D contact the heat roller 81. This also protects the heat roller 81 from damage and reduces an impact.

When the table 25 enters the secondary image transfer position and during secondary image transfer, the moving speed of the table 25 and the peripheral speed of the transfer drum 6 should preferably be coincident with each other. In practice, however, it is difficult to cause the above two speeds to coincide. The illustrative embodiment is successful to cause the two speeds to coincide by using the lugs 25*c* through 25*f*, as will be described hereinafter.

In FIG. 13A, for example, the table 25 entering the secondary image transfer position contracts the transfer drum 6 with its lug 25*c* located at the downstream side in the direction F. At this instant, one of the table 25 and transfer drum 6 follows the other due to friction acting between the lug 25*c* and the drum 6. As a result, the moving speed of the table 25 and the peripheral speed of the transfer drum 6 substantially coincide with each other. The downstream side of the disk D in the direction F then contacts the transfer drum 6, so that the moving speed of the disk substantially coincides with the peripheral speed of the transfer drum. In this condition, image transfer from the transfer drum 6 to the disk D begins.

At the center portion of the disk D in the direction F, although the lugs 25*c* through 25*f* do not contact the transfer drum 6, the disk D and transfer drum 6 contact each other over a great width. The resulting friction between the disk D and the transfer drum 6 allows image transfer to be effected with the moving speed of the disk D and the peripheral speed of the drum 6 substantially coinciding with each other. At the upstream side of the disk D in the direction F, the transfer drum 6 contacts both of the disk D and upstream lugs 25*e* and 25*f*, FIG. 11B, intensifying the friction. Image transfer is therefore effected with the moving speed of the disk D and the peripheral speed of the transfer drum 6 substantially coinciding with each other. In this manner, the moving speed of the disk D and the peripheral speed of the transfer drum 6 remain substantially the same over the entire protection layer surface of the disk D during image transfer. This prevents the toner image from expanding or contracting on the disk D.

Likewise, when the table 25 enters the fixing position and during fixation, the moving speed of the disk D and the peripheral speed of the transfer drum 6 remain substantially the same. This protects the toner image on the disk D from expansion or contraction and thereby obviates an irregular image and irregular gloss.

If desired, the surfaces of the lugs 25*c* through 25*f* expected to contact, e.g., the transfer drum 6 may be roughened in order to further intensify the friction between them and the drum 6. This allows the moving speed of the table 25 and the peripheral speed of the transfer drum 6 to more surely coincide with each other. Specifically, the above surfaces may be provided with surface roughness Rz of 20 or above. Surface roughness Rz below 20 would prevent a desired frictional force from acting between the lugs 25*c* through 25*f* and the transfer drum 6. Alternatively, sandpaper or similar high friction members may be adhered to the surfaces of the lugs 25*c* through 25*f*. The lugs 25*c* through 25*f* themselves may be implemented as high friction members, if desired.

As stated above, the image transfer pressure and fixing pressure each are constant over the entire protection layer surface of the disk D. In addition, the moving speed of the disk D and the peripheral speed of the transfer drum 6 or that of the heat roller 81 remain substantially the same over the entire protection layer surface of the disk D. Consequently, desirable image transfer and desirable fixation are achievable. Further, the collision angle between the disk D and the transfer drum 6 or the heat roller 81 can be reduced to a preselected angle, protecting the drum 6 and roller 81 from damage and reducing an impact ascribable to collision.

Two lugs 25*c* and 25*e* positioned at the left-hand side in FIG. 11B and two lugs 25*d* and 25*f* positioned at the right-hand side each may be contiguous with each other in the form of a single lug, if desired. Such lugs will allow the image transfer pressure and fixation pressure to be more uniform over the entire protection layer surface of the disk D.

Third Modification

Figure 14A:
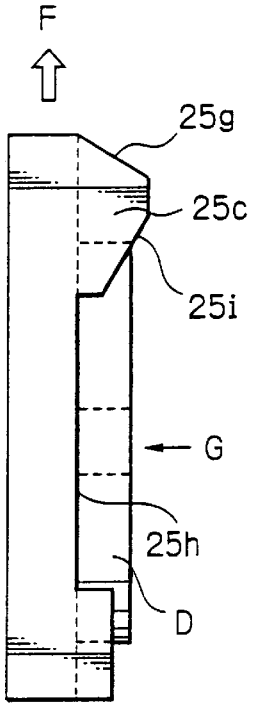
FIG. 14A is a side elevation showing a modification of the third embodiment.
Figure 14B:
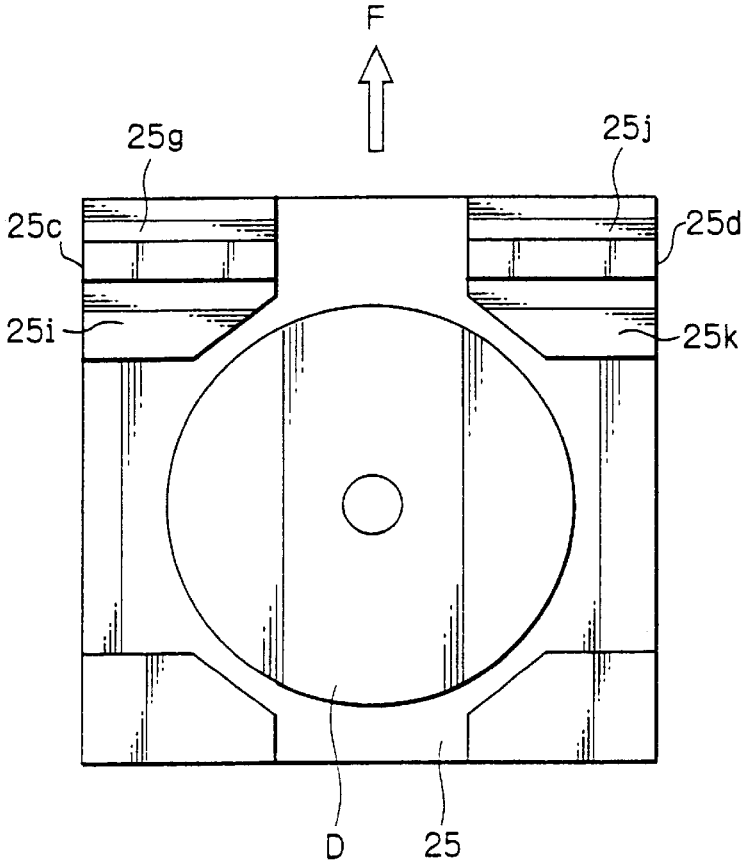
FIG. 14B is a view as seen in a direction G shown in FIG. 14A.

A modification of the illustrative embodiment will be described with reference to FIGS. 14A, 14B and 15. FIG. 14A is a side elevation of the table 25 unique to the modification while FIG. 14 is a view as seen in a direction G shown in FIG. 14A.

As shown in FIG. 14A, the lug 25*c* positioned at the downstream side in the direction F has a maximum height, as measured from the support surface 25*h*, greater than the height of the protection layer surface of the disk D. The lug 25*c* includes a slant 25*g* sequentially rising to a peak from the downstream side toward the upstream side and a slant 25*i* sequentially falling from the peak from the downstream side toward the upstream side. Any point of the slant 25*i* in the widthwise direction perpendicular to the direction F is coincident with the end corner of the protection layer surface of the disk D in the same direction. As shown in FIG. 14B, the lug 25*d* also positioned at the downstream side in the direction F is identical in configuration with the above lug 25*c* and includes an upward slant 25*j* and a downward slant 25*k*.

Figure 15:
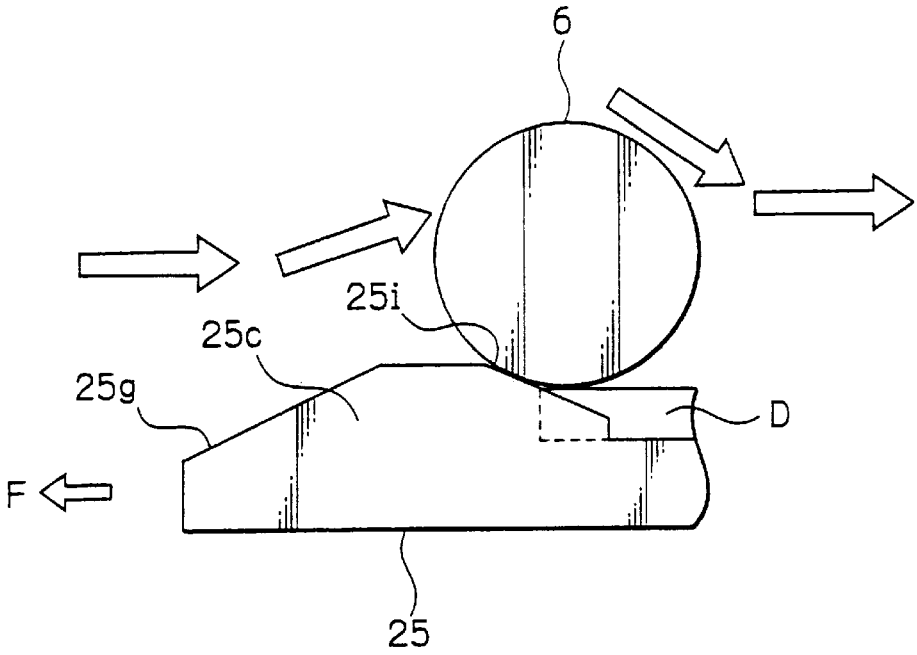
FIG. 15 is a view demonstrating how a transfer drum contacts the optical disk at a secondary image transfer position.

FIG. 15 shows how the transfer drum 6 contacts the disk D at the secondary image transfer position. As shown, when the table 25 holding the disk D moves in the direction F, the transfer drum 6 gets on the peak of the lug 25*c* between the upward slant 25*g* and the downward slant 25*i* while being guided by the upward slant 25*g*. The transfer drum 6 then contacts the disk D while being guided by the downward slant 25*i*. More specifically, the transfer drum 6 contacts the protection layer surface of the disk D from obliquely above the protection layer surface because the peak of the lug 25*c* is higher in level than the protection surface layer. The transfer drum 6 therefore gently contacts or does not contact the end corner of the protection surface of the disk D and is protected from damage.

The heat roller 81 is also protected from damage ascribable to its contact with the disk D although not shown or described specifically.

Fourth Embodiment

Silicone oil or similar parting agent is often coated on the heat roller 81. Therefore, in the third embodiment described above, the parting agent deposits on the surfaces of the lugs 25*c* through 25*f* when the lugs 25*c* through 25*f* contact the heat roller 81. If the lugs 25*c* through 25*f* with the parting agent contact the transfer drum 6, then the parting agent deposits on the drum 6. As a result, during the next image formation, the parting agent locally deposited on the transfer drum 6 obstructs toner transfer from the belt 2 and thereby brings about a defective image. In light of this, in the illustrative embodiment, the disk holding mechanism 21 is constructed to cause a particular member to contact each of the transfer drum 6 and heat roller 81.

Figure 16:
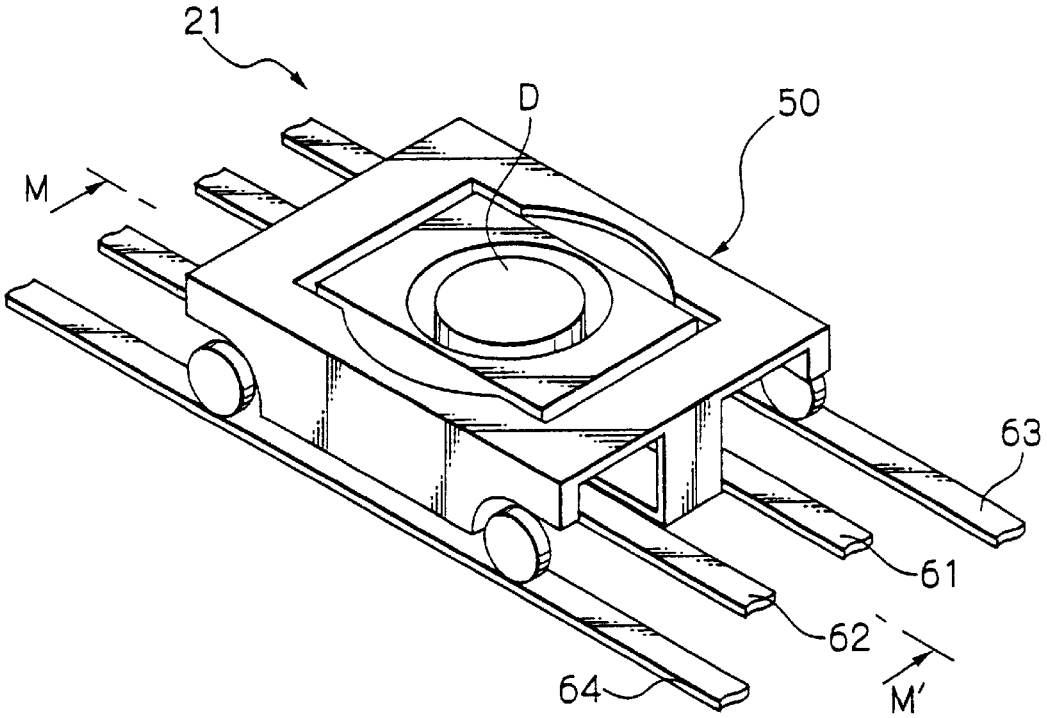
FIG. 16 is an isometric view showing a disk holding mechanism included in a fourth embodiment of the present invention.
Figure 17A:
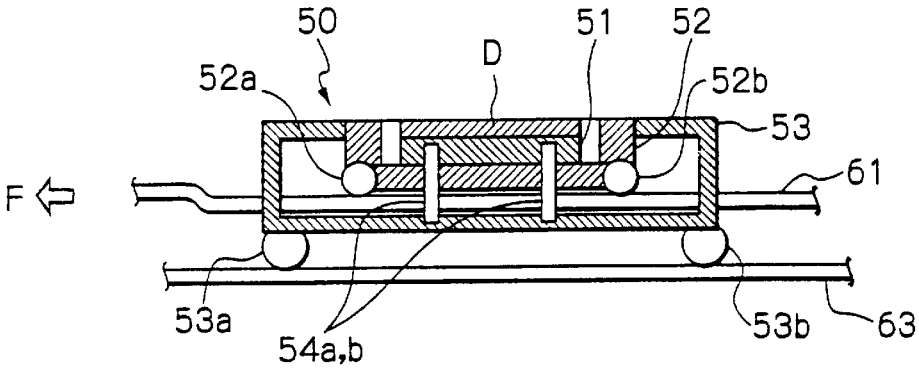
FIG. 17A is a section along line M–M' shown in FIG. 16.

Specifically, as shown in FIG. 16, the disk holding mechanism 21 includes a carriage 50, a pair of rails 61 and 62, and a pair of rails 63 and 64. As shown in FIG. 17A, the carriage 50 includes a table 51, projection members 52 and 53, and a pair of table support pins 54*a* and 54*b*. The table 51 holds the disk D thereon. At the time of secondary image transfer, the projection member 52 projects toward the transfer drum 6 together with the table 51 and contacts the drum 6. At the time of fixation, the projection member 53 projects toward the heat roller 81 together with the table 51 and contacts the heat roller 81. The table support pins 54*a* and 54*b* are studded on the projection member 53 and cause the table 51 to project toward the heat roller 81. Four wheels are mounted on the projection member 52 although only two wheels 52*a* and 52*b* are shown in FIG. 17A. The wheels 52*a* and 52*b* are positioned at the right-hand side in the direction perpendicular to the direction F; the other two wheels, not shown, are positioned at the left-hand side. The wheels 52*a* and 52*b* roll on the rail 61, so that the projection member 52 moves by being guided by the rail 61. Four wheels are also mounted on the other projection member 53 although only two wheels 53*a* and 53*b* are shown in FIG. 17A. The wheels 53*a* and 53*b* are positioned at the right-hand side in the above direction; the other two wheels, not shown, are positioned at the left-hand side. The wheels 53*a* and 53*b* roll on the rail 63, so that the projection member 53 moves by being guided by the rail 63.

Figure 17B:
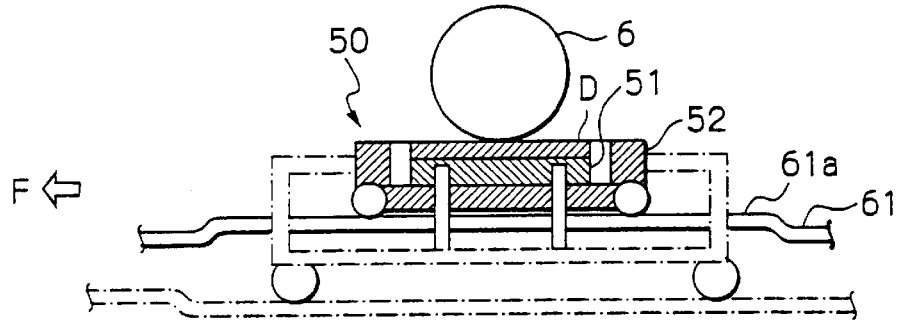
FIG. 17B demonstrates how a carriage operates at a secondary image transfer position.

FIG. 17A shows the position of the carriage 50 being conveyed in the direction F during image formation. As shown in FIG. 17B, the rail 61 includes a stepped portion 61*a* corresponding in position to the secondary image transfer position. At the image transfer position, the stepped portion 61*a* causes the projection member 52 and table 51 to project upward together. As a result, the projection member 52 and disk D contact the transfer drum 6. The projection member 52 receives part of the image transfer pressure and therefore maintains the pressure substantially uniform over the entire protection layer surface of the disk D.

Figure 17C:
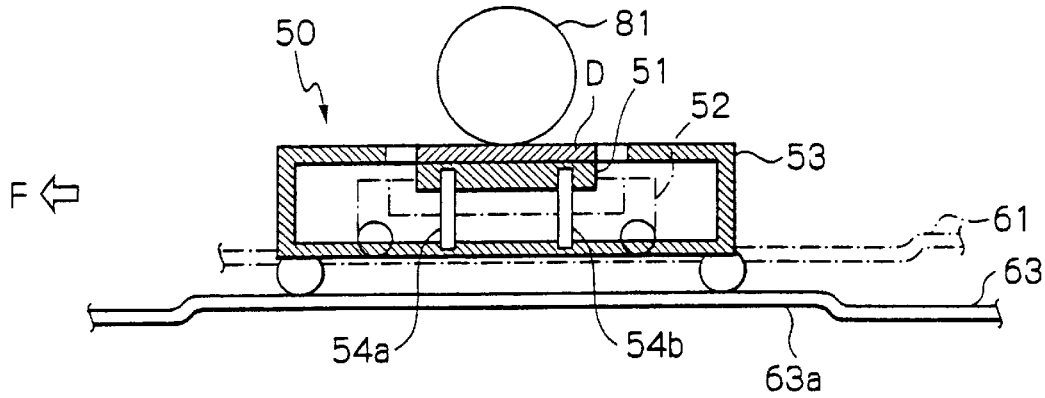
FIG. 17C demonstrates how a carriage operates at the fixing position.

As shown in FIG. 17C, the rail 63 includes a stepped portion 63*a*. When the carriage 50 arrives at the fixing position, the projection member 52 retracts downward by being guided by the rail 61. At the same time, the stepped portion 63*a* of the rail 63 causes the projection member 53 to project toward the heat roller 81. As a result, the table support pins 54*a* and 54*b* cause the table 61 to project toward the heat roller 81. The projection member 53 and disk D therefore contact the heat roller 81. The projection member 53 receives part of the fixing pressure and therefore maintains the pressure substantially uniform over the entire protection layer surface of the disk D. At this instant, the projection member 52 does not protrude toward the heat roller 81 or contact it and is therefore free from the deposition of the parting agent.

Fourth Modification

Figure 18A:
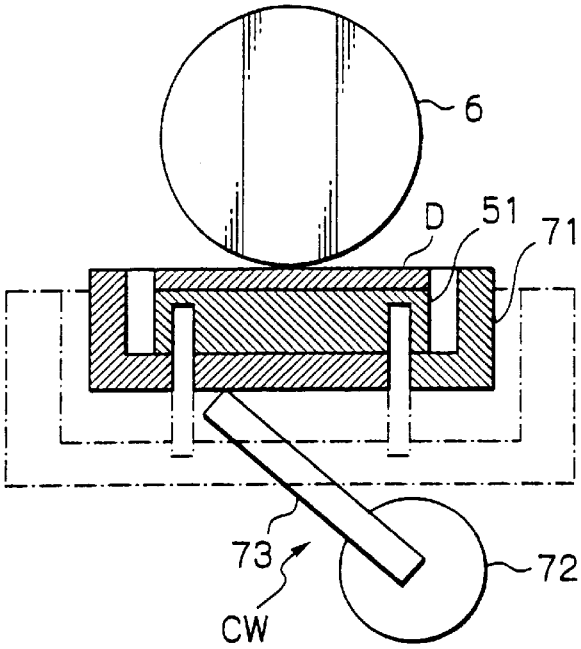
FIG. 18A demonstrates the operation of a modification of the fourth embodiment to occur at the secondary image transfer position.
Figure 18B:
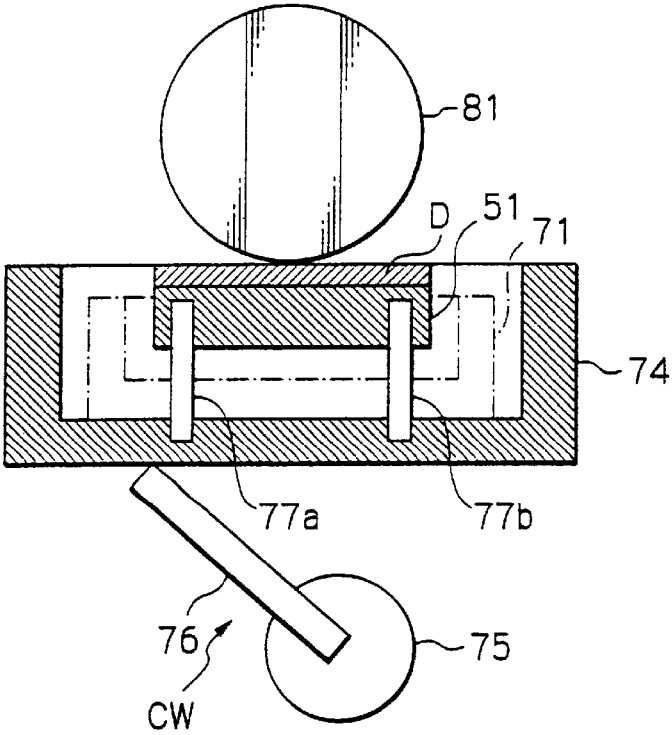
FIG. 18B demonstrates the operation of a modification of the fourth embodiment to occur at the fixing position.

FIGS. 18A and 18B show a modification of the illustrative embodiment. As shown in FIG. 18A, a motor 72 is mounted on a base plate, not shown, for causing a projection member 71 to project toward the transfer drum 6. The motor 72 includes an arm 73. At the secondary image transfer position, the motor 72 is driven to rotate the arm 73 clockwise (CW) The arm 73 causes the projection member 71 to project toward the transfer drum 6. The projection member 71 and disk D therefore contact the transfer drum 6. The projection member 71 receives part of the image transfer pressure and therefore maintains the pressure substantially uniform over the entire protection layer surface of the disk D.

As shown in FIG. 18B, a motor 75 is mounted on the base plate, not shown, for causing a projection member 74 to project toward the heat roller 81. The motor 75 includes an arm 76. At the fixing position, the motor 75 is driven to rotate the arm 76 clockwise (CW). The arm 76 causes the projection member 74 to project toward the heat roller 81. As a result, the table support pins 77*a* and 77*b* cause the table 51 to protrude toward the heat roller 81. The projection member 74 and disk D therefore contact the heat roller 81. The projection member 74 receives part of the fixing pressure and therefore maintains the pressure substantially uniform over the entire protection layer surface of the disk D. At this instant, the projection member 71 does not protrude toward the heat roller 81 or contact it and is therefore free from the deposition of the parting agent.

Fifth Modification

Figure 19:
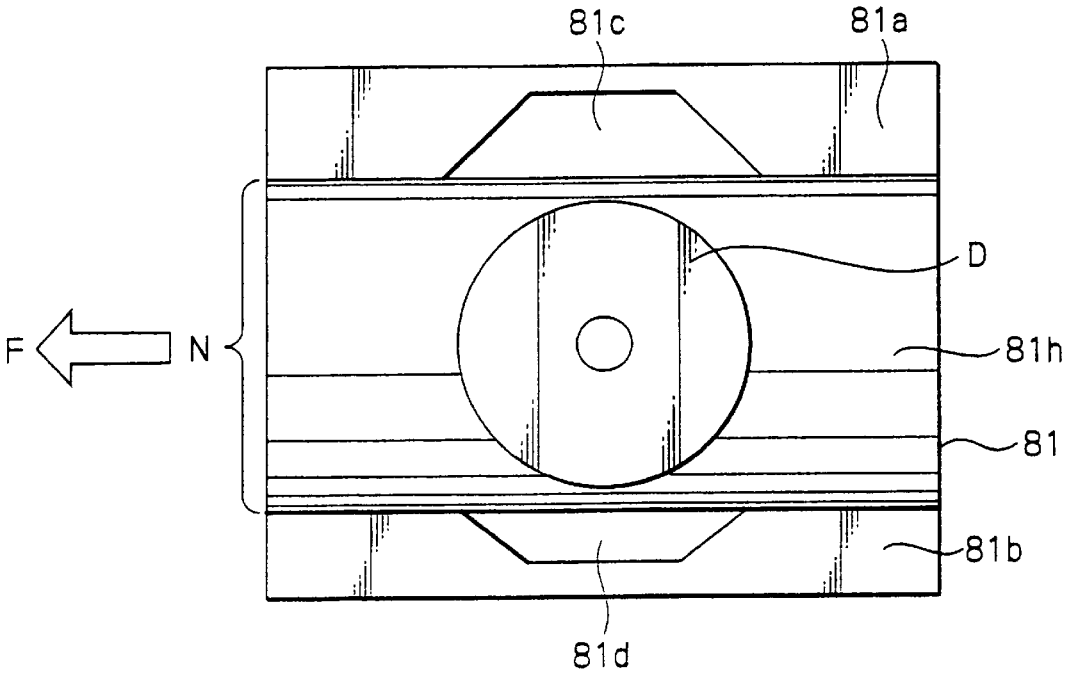
FIG. 19 is a view showing another modification of the fourth embodiment.

Another modification of the illustrative embodiment will be described with reference to FIG. 19. As shown, a table 81 unique to this modification has a range N corresponding to the image forming range of the transfer drum 6 not shown. Lugs 81*a* and 81*b* protrude from the table 81 at opposite sides of the range N in the direction perpendicular to the direction F. The lugs 81*a* and 81*b* each are higher in level than a support surface 81*h* included in the table 81. Notches 81*c* and 81*d* are respectively formed in the lugs 81*a* and 81*b*. The bottoms of the notches 81*c* and 81*d* are flush with the disk support surface 81*h*. The notches 81*c* and 82*d* make the image transfer pressure and fixing pressure to act on the disk D substantially uniform.

At the fixing position, the lugs 81*a* and 81*b* contact the heat roller 81 with the result that silicone oil or similar parting agent deposits on the lugs 81*a* and 81*b*. The parting agent is likely to deposit on the transfer drum 6 during the next image formation because the lugs 81*a* and 81*b* contact the drum 6. However, the parting agent deposits on the transfer drum 6 outside of the image forming range and therefore has no influence on image formation. This obviates defective images stated earlier.

Various modifications will become possible for those skilled in the art after receiving the teachings of the present disclosure without departing from the scope thereof.

What is claimed is:

1. An apparatus for forming an image on a synthetic resin sheet, comprising;

an image carrier;

toner image forming means for forming a toner image on said image carrier;

a holding member for holding the synthetic resin sheet on a surface thereof that is resiliently displaceable when subjected to a force other than a weight of said synthetic resin sheet;

conveying means for conveying the synthetic resin sheet held on the surface of said holding member along a preselected path;

a support member formed with a pair of lugs at opposite sides thereof in a direction perpendicular to a direction of sheet conveyance for supporting said holding member such that the surface of said holding member is resiliently displaceable, wherein tops of said pair of lugs are resiliently displaced when subjected to a force other than a weight of said holding member and a weight of said synthetic resin sheet;

transferring means for transferring the toner image from said image carrier to the synthetic resin sheet being conveyed by said conveying means;

fixing means including a fixing member for fixing the toner image transferred to the synthetic resin sheet; and rollers mounted on at least one of said image carrier and said fixing member at preselected positions for causing the surface of said holding member to be resiliently displaced such that an image surface of the synthetic resin sheet and a circumference of at least one of said image carrier and said fixing member overlap each other by a preselected amount.

2. The apparatus as claimed in claim 1, wherein said holding member comprises:

at least one of gears for transfer speed synchronization mounted on a rotary shaft of said image carrier coaxially with said image carrier and gears for fixation speed synchronization mounted on a rotary shaft of said fixing member coaxially with said fixing member; and rack gears capable of respectively meshing with said gears of at least one of said image carrier and said fixing member.

3. The apparatus as claimed in claim 1, wherein said rollers are coaxially mounted on at least one of said rotary shaft of said image carrier and said rotary shaft of said fixing member, and at least one of circumferential surfaces of said rollers and a circumferential surface of said holding member capable of contacting said circumferential surfaces comprises a high friction member having a greater coefficient of friction than a base material of at least one of said roller and said holding member.

4. An apparatus for forming an image on a synthetic resin sheet, comprising;

an image carrier;

toner image forming means for forming a toner image on said image carrier;

a holding member for holding the synthetic resin sheet on a surface thereof;

conveying means for conveying the synthetic resin sheet held on the surface of said holding member along a preselected path;

a support member formed with a pair of lugs at opposite sides thereof in a direction perpendicular to a direction of sheet conveyance for supporting said holding member such that the surface of said holding member is resiliently displaceable, wherein tops of said pair of lugs are resiliently displaced when subjected to a force other than a weight of said holding member and a weight of said synthetic resin sheet;

transferring means for transferring the toner image from said image carrier to the synthetic resin sheet being conveyed by said conveying means;

fixing means including a fixing member for fixing the toner image transferred to the synthetic resin sheet;

wherein the tops of said pair of lugs and a circumference of at least one of said image carrier and said fixing member contact each other such that an image surface of the synthetic resin sheet and said circumference overlap each other by a preselected amount.

5. The apparatus as claimed in claim 4, wherein said support member comprises:

at least one of gears for transfer speed synchronization mounted on a rotary shaft of said image carrier coaxially with said image carrier and gears for fixation speed synchronization mounted on a rotary shaft of said fixing member coaxially with said fixing member; and rack gears capable of respectively meshing with said gears of at least one of said image carrier and said fixing member.

6. The apparatus as claimed in claim 4, wherein at least one of the tops of said pair of lugs, a circumferential surface of said image carrier capable of contacting said tops and a circumferential surface of said fixing member capable of contacting said tops comprises a high friction member having a greater coefficient of friction than a base material of at least one of said lugs, said image carrier and said fixing member.

7. The apparatus as claimed in claim 4, wherein said support member is formed with a slant inclined toward said image carrier or said fixing member from a downstream side to an upstream side in a direction of sheet conveyance at a downstream end of said support member, and said slant is capable of contacting said image carrier or said fixing member.

8. An apparatus for forming an image on a synthetic resin sheet, comprising;

an image carrier;

toner image forming means for forming a toner image on said image carrier;

a holding member for holding the synthetic resin sheet on a surface thereof;

conveying means for conveying the synthetic resin sheet held on the surface of said holding member along a preselected path;

a support member formed with a pair of tugs at opposite sides thereof in a direction perpendicular to a direction of sheet conveyance for supporting said holding member such that the surface of said holding member is resiliently displaceable, wherein tops of said pair of lugs are resiliently displaced when subjected to a force other than a weight of said holding member and a weight of said synthetic resin sheet;

transferring means for transferring the toner image from said image carrier to the synthetic resin sheet being conveyed by said conveying means;

fixing means including a fixing member for fixing the toner image transferred to the synthetic resin sheet; and rollers mounted on at least one of said image carrier and said fixing member at preselected positions and capable of contacting a surface of said support member to thereby resiliently displace said surface such that an image surface of the synthetic resin sheet and a circumference of at least one of said image carrier and said fixing member overlap each other by a preselected amount.

9. The apparatus as claimed in claim 8, wherein said support member comprises:

at least one of gears for transfer speed synchronization mounted on a rotary shaft of said image carrier coaxially with said image carrier and gears for fixation speed synchronization mounted on a rotary shaft of said fixing member coaxially with said fixing member; and rack gears capable of respectively meshing with at least one of said gears of said image carrier and said fixing member.

10. The apparatus as claimed in claim 8, wherein said rollers are coaxially mounted on at least one of said rotaty shaft of said image carrier and said rotary shaft of said fixing member, and at least one of circumferential surfaces of said rollers and a circumferential surface of said holding member capable of contacting said circumferential surfaces comprises a high friction member having a greater coefficient of friction than a base material of at least one of said rollers and said holding member.

11. The apparatus as claimed in claim 8, wherein said support member is formed with a slant inclined toward said image carrier or said fixing member from a downstream side to an upstream side in a direction of sheet conveyance at a downstream end of said support member, and said slant is capable of contacting said image carrier or said fixing member.

12. An apparatus for forming an image on a synthetic resin sheet, comprising:

conveying means including a holding member for conveying the synthetic resin sheet while holding said synthetic resin sheet;

transferring means for transferring a toner image formed on an image carrier, which has an endless, movable surface, to a surface of the synthetic resin sheet being conveyed by said conveying means by exerting a pressure; and fixing means including a fixing member, which has an endless, movable surface, for fixing the toner image on the synthetic resin sheet being conveyed by said conveying means by exerting a pressure;

wherein a surface of said holding means is formed with lugs at opposite sides of a portion of the synthetic resin whose width, as measured in a direction perpendicular to a direction of sheet conveyance, is smaller than a maximum width of said synthetic resin sheet, said lugs having a substantially same height as said synthetic resin sheet and contacting said image carrier and said fixing member while said synthetic resin sheet is conveyed.

13. The apparatus as claimed in claim 12, wherein at least tops of said lugs are displaceable relative to said image carrier and said fixing member.

14. The apparatus as claimed in claim 12, wherein said image carrier and said fixing member each have an elastic surface, and said lugs each have a height lying in a range of ±1 mm with respect to the height of a surface of the synthetic resin sheet when said synthetic resin sheet is set on said holding member.

15. The apparatus as claimed in claim 12, wherein a sum of a width of the synthetic resin sheet in a direction perpendicular to the direction of sheet conveyance and a width of said lugs is substantially identical in said direction.

16. The apparatus as claimed in claim 12, wherein said lugs comprise first lugs positioned at opposite sides of a portion of the synthetic resin whose width is smaller than the maximum width and having substantially a same height as said synthetic resin sheet and second lugs positioned at a downstream side in the direction of sheet conveyance and having a greater height than the surface of said synthetic resin sheet, and at least one of said first lugs and said second lugs has a surface roughness Rz of 20 or above.

17. The apparatus as claimed in claim 12, wherein said lugs comprise first lugs positioned at opposite sides of a portion of the synthetic resin whose width is smaller than the maximum width and having substantially a same height as said synthetic resin sheet and second lugs positioned at a downstream side in the direction of sheet conveyance and having a greater height than the surface of said synthetic resin sheet, and at least one of said first lugs and second lugs is covered with a high friction member having a greater coefficient of friction than the surface of said holding member or is implemented by said high friction member.

18. An apparatus for forming an image on a synthetic resin sheet, comprising:

conveying means including a holding member for conveying the synthetic resin sheet while holding said synthetic resin sheet;

transferring means for transferring a toner image formed on an image carrier, which has an endless, movable surface, to a surface of the synthetic resin sheet being conveyed by said conveying means by exerting a pressure; and fixing means including a fixing member, which has an endless, movable surface, for fixing the toner image on the synthetic resin sheet being conveyed by said conveying means by exerting a pressure;

wherein the surface of said holding member is formed with lugs at a downstream side in a direction of sheet conveyance, said lugs having a greater height than said surface and contacting said image carrier and said fixing member while the synthetic resin sheet is conveyed.

19. The apparatus as claimed in claim 18, wherein said lugs comprise first lugs positioned at opposite sides of a portion of the synthetic resin whose width is smaller than the maximum width and having substantially a same height as said synthetic resin sheet and second lugs positioned at a downstream side in the direction of sheet conveyance and having a greater height than the surface of said synthetic resin sheet, and at least one of said first lugs and said second lugs has a surface roughness Rz of 20 or above.

20. The apparatus as claimed in claim 18, wherein said lugs comprise first lugs positioned at opposite sides of a portion of the synthetic resin whose width is smaller than the maximum width and having substantially a same height as said synthetic resin sheet and second lugs positioned at a downstream side in the direction of sheet conveyance and having a greater height than the surface of said synthetic resin sheet, and at least one of said first lugs and second lugs is covered with a high friction member having a greater coefficient of friction than the surface of said holding member or is implemented by said high friction member.

21. An apparatus for forming an image on a synthetic resin sheet, comprising:

conveying means including a holding member for conveying the synthetic resin sheet while holding said synthetic resin sheet;

transferring means for transferring a toner image formed on an image carrier, which has an endless, movable surface, to a surface of the synthetic resin sheet being conveyed by said conveying means by exerting a pressure;

fixing means including a fixing member, which has an endless, movable surface, for fixing the toner image on the synthetic resin sheet being conveyed by said conveying means by exerting a pressure; and biasing means for biasing said holding member toward at least one of said image carrier and said fixing member;

wherein at a downstream side in the direction of sheet conveyance a surface of said holding member is formed with lugs each including an upward slant, which rises from the downstream side toward an upstream side and is higher in level than said surface, said slant contacting at least one of said image carrier and said fixing member first.

22. The apparatus as claimed in claim 21, wherein said lugs each are higher in level than an image surface of the synthetic resin sheet, said lugs each include, at the upstream side, a downward slant falling from the downstream side toward the upstream side, and a surface of said image carrier or a surface of said fixing member contacts the image surface of the synthetic resin sheet while moving in contact with said downward slant.

23. An apparatus for forming an image on a synthetic resin sheet, comprising:

conveying means including a holding member for conveying the synthetic resin sheet while holding said synthetic resin sheet;

transferring means for transferring a toner image formed on an image carrier, which has an endless, movable surface, to a surface of the synthetic resin sheet being conveyed by said conveying means by exerting a pressure; and fixing means including a fixing member, which has an endless, movable surface, for fixing the toner image on the synthetic resin sheet being conveyed by said conveying means by exerting a pressure;

wherein said lugs comprise first lugs positioned at opposite sides of a portion of the synthetic resin whose width is smaller than the maximum width and having substantially a same height as said synthetic resin sheet and second lugs positioned at a downstream side in the direction of sheet conveyance and having a greater height than the surface of said synthetic resin sheet, said first lugs and said second lugs contacting said image carrier outside of an image forming range of said image carrier.

24. An apparatus for forming an image on a synthetic resin sheet, comprising:

conveying means including a holding member for conveying the synthetic resin sheet while holding said synthetic resin sheet;

transferring means for transferring a toner image formed on an image carrier, which has an endless, movable surface, to a surface of the synthetic resin sheet being conveyed by said conveying means by exerting an image transfer pressure; and fixing means including a fixing member, which has an endless, movable surface, for fixing the toner image on the synthetic resin sheet being conveyed by exerting a fixing pressure;

an image transfer pressure receiving member for receiving the image transfer pressure on contacting said image carrier; and a support member formed with a pair of lugs at opposite sides thereof in a direction perpendicular to a direction of sheet conveyance for supporting said holding member such that the surface of said holding member is resiliently displaceable, wherein tops of said pair of lugs are resiliently displaced when subjected to a force other than a weight of said holding member and a weight of said synthetic resin sheet;

a fixing pressure receiving means for receiving the fixing pressure on contacting said fixing member;

wherein a portion of said image transfer pressure receiving member expected to contact said image carrier does not contact said fixing member during fixation while a portion of said fixing pressure receiving member expected to contact said fixing member does not contact said image carrier during image transfer.

25. An apparatus for forming an image on a synthetic resin sheet, comprising;

an image carrier;

a toner image forming device for forming a toner image on said image carrier;

a holding member for holding the synthetic resin sheet on a surface thereof that is resiliently displaceable when subjected to a force other than a weight of said synthetic resin sheet;

a conveying device for conveying the synthetic resin sheet held on the surface of said holding member along a preselected path;

a transferring device for transferring the toner image from said image carrier to the synthetic resin sheet being conveyed by said conveying device;

a fixing device including a fixing member for fixing the toner image transferred to the synthetic resin sheet;

a support member formed with a pair of lugs at opposite sides thereof in a direction perpendicular to a direction of sheet conveyance for supporting said holding member such that the surface of said holding member is resiliently displaceable, wherein tops of said pair of lugs are resiliently displaced when subjected to a force other than a weight of said holding member and a weight of said synthetic resin sheet; and rollers mounted on at least one of said image carrier and said fixing member at preselected positions for causing the surface of said holding member to be resiliently displaced such that an image surface of the synthetic resin sheet and a circumference of at least one of said image carrier and said fixing member overlap each other by a preselected amount.

26. The apparatus as claimed in claim 25, wherein said holding member comprises:

at least one of gears for transfer speed synchronization mounted on a rotary shaft of said image carrier coaxially with said image carrier and gears for fixation speed synchronization mounted on a rotary shaft of said fixing member coaxially with said fixing member; and rack gears capable of respectively meshing with said gears of at least one of said image carrier and said fixing member.

27. The apparatus as claimed in claim 25, wherein said rollers are coaxially mounted on at least one of said rotaty shaft of said image carrier and said rotary shaft of said fixing member, and at least one of circumferential surfaces of said rollers and a circumferential surface of said holding member capable of contacting said circumferential surfaces comprises a high friction member having a greater coefficient of friction than a base material of at least one of said roller and said holding member.

28. An apparatus for forming an image on a synthetic resin sheet, comprising;

an image carrier;

a toner image forming device for forming a toner image on said image carrier;

a holding member for holding the synthetic resin sheet on a surface thereof;

a conveying device for conveying the synthetic resin sheet held on the surface of said holding member along a preselected path;

a support member formed with a pair of lugs at opposite sides thereof in a direction perpendicular to a direction of sheet conveyance for supporting said holding member such that the surface of said holding member is resiliently displaceable, wherein tops of said pair of lugs are resiliently displaced when subjected to a force other than a weight of said holding member and a weight of said synthetic resin sheet;

a transferring device for transferring the toner image from said image carrier to the synthetic resin sheet being conveyed by said conveying device;

a fixing device including a fixing member for fixing the toner image transferred to the synthetic resin sheet;

wherein the tops of said pair of lugs and a circumference of at least one of said image carrier and said fixing member contact each other such that an image surface of the synthetic resin sheet and said circumference overlap each other by a preselected amount.

29. The apparatus as claimed in claim 28, wherein said support member comprises:

at least one of gears for transfer speed synchronization mounted on a rotary shaft of said image carrier coaxially with said image carrier and gears for fixation speed synchronization mounted on a rotary shaft of said fixing member coaxially with said fixing member; and rack gears capable of respectively meshing with said gears of at least one of said image carrier and said fixing member.

30. The apparatus as claimed in claim 28, wherein at least one of the tops of said pair of lugs, a circumferential surface of said image carrier capable of contacting said tops and a circumferential surface of said fixing member capable of contacting said tops comprises a high friction member having a greater coefficient of friction than a base material of at least one of said lugs, said image carrier and said fixing member.

31. The apparatus as claimed in claim 28, wherein said support member is formed with a slant inclined toward said image carrier or said fixing member from a downstream side to an upstream side in a direction of sheet conveyance at a downstream end of said support member, and said slant is capable of contacting said image carrier or said fixing member.

32. An apparatus for forming an image on a synthetic resin sheet, comprising;

an image carrier;

a toner image forming device for forming a toner image on said image carrier;

a holding member for holding the synthetic resin sheet on a surface thereof;

a conveying device for conveying the synthetic resin sheet held on the surface of said holding member along a preselected path;

a support member formed with a pair of lugs at opposite sides thereof in a direction perpendicular to a direction of sheet conveyance for supporting said holding member such that the surface of said holding member is resiliently displaceable, wherein tops of said pair of lugs are resiliently displaced when subjected to a force other than a weight of said holding member and a weight of said synthetic resin sheet;

a transferring device for transferring the toner image from said image carrier to the synthetic resin sheet being conveyed by said conveying device;

a fixing device including a fixing member for fixing the toner image transferred to the synthetic resin sheet; and rollers mounted on at least one of said image carrier and said fixing member at preselected positions and capable of contacting a surface of said support member to thereby resiliently displace said surface such that an image surface of the synthetic resin sheet and a circumference of at least one of said image carrier and said fixing member overlap each other by a preselected amount.

33. The apparatus as claimed in claim 32, wherein said support member comprises:

at least one of gears for transfer speed synchronization mounted on a rotary shaft of said image carrier coaxially with said image carrier and gears for fixation speed synchronization mounted on a rotary shaft of said fixing member coaxially with said fixing member; and rack gears capable of respectively meshing with at least one of said gears of said image carrier and said fixing member.

34. The apparatus as claimed in claim 32, wherein said rollers are coaxially mounted on at least one of said rotaty shaft of said image carrier and said rotary shaft of said fixing member, and at least one of circumferential surfaces of said rollers and a circumferential surface of said holding member capable of contacting said circumferential surfaces comprises a high friction member having a greater coefficient of friction than a base material of at least one of said rollers and said holding member.

35. The apparatus as claimed in claim 32, wherein said support member is formed with a slant inclined toward said image carrier or said fixing member from a downstream side to an upstream side in a direction of sheet conveyance at a downstream end of said support member, and said slant is capable of contacting said image carrier or said fixing member.

36. An apparatus for forming an image on a synthetic resin sheet, comprising:

a conveying device including a holding member for conveying the synthetic resin sheet while holding said synthetic resin sheet;

a transferring device for transferring a toner image formed on an image carrier, which has an endless, movable surface, to a surface of the synthetic resin sheet being conveyed by said conveying device by exerting a pressure; and a fixing device including a fixing member, which has an endless, movable surface, for fixing the toner image on the synthetic resin sheet being conveyed by said conveying device by exerting a pressure;

wherein a surface of said holding device is formed with lugs at opposite sides of a portion of the synthetic resin whose width, as measured in a direction perpendicular to a direction of sheet conveyance, is smaller than a maximum width of said synthetic resin sheet, said lugs having a substantially same height as said synthetic resin sheet and contacting said image carrier and said fixing member while said synthetic resin sheet is conveyed.

37. The apparatus as claimed in claim 36, wherein at least tops of said lugs are displaceable relative to said image carrier and said fixing member.

38. The apparatus as claimed in claim 36, wherein said image carrier and said fixing member each have an elastic surface, and said lugs each have a height lying in a range of ±1 mm with respect to the height of a surface of the synthetic resin sheet when said synthetic resin sheet is set on said holding member.

39. The apparatus as claimed in claim 36, wherein a sum of a width of the synthetic resin sheet in a direction perpendicular to the direction of sheet conveyance and a width of said lugs is substantially identical in said direction.

40. The apparatus as claimed in claim 36, wherein said lugs comprise first lugs positioned at opposite sides of a portion of the synthetic resin whose width is smaller than the maximum width and having substantially a same height as said synthetic resin sheet and second lugs positioned at a downstream side in the direction of sheet conveyance and having a greater height than the surface of said synthetic resin sheet, and at least one of said first lugs and said second lugs has a surface roughness Rz of 20 or above.

41. The apparatus as claimed in claim 36, wherein said lugs comprise first lugs positioned at opposite sides of a portion of the synthetic resin whose width is smaller than the maximum width and having substantially a same height as said synthetic resin sheet and second lugs positioned at a downstream side in the direction of sheet conveyance and having a greater height than the surface of said synthetic resin sheet, and at least one of said first lugs and second lugs is covered with a high friction member having a greater coefficient of friction than the surface of said holding member or is implemented by said high friction member.

42. An apparatus for forming an image on a synthetic resin sheet, comprising:

a conveying device including a holding member for conveying the synthetic resin sheet while holding said synthetic resin sheet;

a transferring device for transferring a toner image formed on an image carrier, which has an endless, movable surface, to a surface of the synthetic resin sheet being conveyed by said conveying device by exerting a pressure; and a fixing device including a fixing member, which has an endless, movable surface, for fixing the toner image on the synthetic resin sheet being conveyed by said conveying device by exerting a pressure;

wherein the surface of said holding member is formed with lugs at a downstream side in a direction of sheet conveyance, said lugs having a greater height than said surface and contacting said image carrier and said fixing member while the synthetic resin sheet is conveyed.

43. The apparatus as claimed in claim 42, wherein said lugs comprise first lugs positioned at opposite sides of a portion of the synthetic resin whose width is smaller than the maximum width and having substantially a same height as said synthetic resin sheet and second lugs positioned at a downstream side in the direction of sheet conveyance and having a greater height than the surface of said synthetic resin sheet, and at least one of said first lugs and said second lugs has a surface roughness Rz of 20 or above.

44. The apparatus as claimed in claim 42, wherein said lugs comprise first lugs positioned at opposite sides of a portion of the synthetic resin whose width is smaller than the maximum width and having substantially a same height as said synthetic resin sheet and second lugs positioned at a downstream side in the direction of sheet conveyance and having a greater height than the surface of said synthetic resin sheet, and at least one of said first lugs and second lugs is covered with a high friction member having a greater coefficient of friction than the surface of said holding member or is implemented by said high friction member.

45. An apparatus for forming an image on a synthetic resin sheet, comprising:

a conveying device including a holding member for conveying the synthetic resin sheet while holding said synthetic resin sheet;

a transferring device for transferring a toner image formed on an image carrier, which has an endless, movable surface, to a surface of the synthetic resin sheet being conveyed by said conveying device by exerting a pressure;

a fixing device including a fixing member, which has an endless, movable surface, for fixing the toner image on the synthetic resin sheet being conveyed by said conveying device by exerting a pressure; and a biasing device for biasing said holding member toward at least one of said image carrier and said fixing member;

wherein at a downstream side in the direction of sheet conveyance a surface of said holding member is formed with lugs each including an upward slant, which rises from the downstream side toward an upstream side and is higher in level than said surface, said slant contacting at least one of said image carrier and said fixing member first.

46. The apparatus as claimed in claim 45, wherein said lugs each are higher in level than an image surface of the synthetic resin sheet, said lugs each include, at the upstream side, a downward slant falling from the downstream side toward the upstream side, and a surface of said image carrier or a surface of said fixing member contacts the image surface of the synthetic resin sheet while moving in contact with said downward slant.

47. An apparatus for forming an image on a synthetic resin sheet, comprising:

a conveying device including a holding member for conveying the synthetic resin sheet while holding said synthetic resin sheet;

a transferring device for transferring a toner image formed on an image carrier, which has an endless, movable surface, to a surface of the synthetic resin sheet being conveyed by said conveying device by exerting a pressure; and a fixing device including a fixing member, which has an endless, movable surface, for fixing the toner image on the synthetic resin sheet being conveyed by said conveying device by exerting a pressure;

wherein said lugs comprise first lugs positioned at opposite sides of a portion of the synthetic resin whose width is smaller than the maximum width and having substantially a same height as said synthetic resin sheet and second lugs positioned at a downstream side in the direction of sheet conveyance and having a greater height than the surface of said synthetic resin sheet, said first lugs and said second lugs contacting said image carrier outside of an image forming range of said image carrier.

48. An apparatus for forming an image on a synthetic resin sheet, comprising:

a conveying device including a holding member for conveying the synthetic resin sheet while holding said synthetic resin sheet;

a transferring device for transferring a toner image formed on an image carrier, which has an endless, movable surface, to a surface of the synthetic resin sheet being conveyed by said conveying device by exerting a image transfer pressure; and a support member formed with a pair of lugs at opposite sides thereof in a direction perpendicular to a direction of sheet conveyance for supporting said holding member such that the surface of said holding member is resiliently displaceable, wherein tops of said pair of lugs are resiliently displaced when subjected to a force other than a weight of said holding member and a weight of said synthetic resin sheet;

a fixing device including a fixing member, which has an endless, movable surface, for fixing the toner image on the synthetic resin sheet being conveyed by exerting a fixing pressure;

an image transfer pressure receiving member for receiving the image transfer pressure on contacting said image carrier; and a fixing pressure receiving device for receiving the fixing pressure on contacting said fixing member;

wherein a portion of said image transfer pressure receiving member expected to contact said image carrier does not contact said fixing member during fixation while a portion of said fixing pressure receiving member expected to contact said fixing member does not contact said image carrier during image transfer.

49. An apparatus for forming an image on a synthetic resin sheet, comprising;

an image carrier;

toner image forming means for forming a toner image on said image carrier;

a holding member for holding the synthetic resin sheet on a surface thereof;

conveying means for conveying the synthetic resin sheet held on the surface of said holding member along a preselected path;

a support member supporting said holding member such that the surface of said holding member is resiliently displaceable, wherein said support member is resiliently displaceable when subjected to a force other than a weight of said holding member and a weight of the synthetic resin sheet;

transferring means for transferring the toner image from said image carrier to the synthetic resin sheet being conveyed by said conveying means;

fixing means including a fixing member for fixing the toner image transferred to the synthetic resin sheet; and rollers mounted on at least one of said image carrier and said fixing member at preselected positions and capable of contacting a surface of said support member to thereby resiliently displace said surface such that an image surface of the synthetic resin sheet and a circumference of at least one of said image carrier and said fixing member overlap each other by a preselected amount, wherein said support member is formed with a slant inclined toward said image carrier or said fixing member from a downstream side to an upstream side in a direction of sheet conveyance at a downstream end of said support member, and said slant is capable of contacting said image carrier or said fixing member.

50. An apparatus for forming an image on a synthetic resin sheet, comprising;

an image carrier;

a toner image forming device for forming a toner image on said image carrier;

a holding member for holding the synthetic resin sheet on a surface thereof;

a conveying device for conveying the synthetic resin sheet held on the surface of said holding member along a preselected path;

a support member supporting said holding member such that the surface of said holding member is resiliently displaceable, wherein said support member is resiliently displaceable when subjected to a force other than a weight of said holding member and a weight of the synthetic resin sheet;

a transferring device for transferring the toner image from said image carrier to the synthetic resin sheet being conveyed by said conveying device;

a fixing device including a fixing member for fixing the toner image transferred to the synthetic resin sheet; and rollers mounted on at least one of said image carrier and said fixing member at preselected positions and capable of contacting a surface of said support member to thereby resiliently displace said surface such that an image surface of the synthetic resin sheet and a circumference of at least one of said image carrier and said fixing member overlap each other by a preselected amount, wherein said support member is formed with a slant inclined toward said image carrier or said fixing member from a downstream side to an upstream side in a direction of sheet conveyance at a downstream end of said support member, and said slant is capable of contacting said image carrier or said fixing member.

* * * * *

UNITED STATES PATENT AND TRADEMARK OFFICE

CERTIFICATE OF CORRECTION

PATENT NO. : 6,556,803 B2 
DATED : April 29, 2003
INVENTOR(S) : Hiroshi Akema et al.

It is certified that error appears in the above-identified patent and that said Letters Patent is hereby corrected as shown below:

Column 5,
Line 33, change “SC” to -- 5C --.

Column 19,
Line 39, “tugs” to -- lugs --; and “tags” to -- lugs --.

Column 20,
Line 5, change “rotaty” to -- rotary --.

Column 23,
Line 59, change “rotaty” to -- rotary --.

Column 25,
Line 32, change “rotaty” to -- rotary --.

Signed and Sealed this

Ninth Day of December, 2003

JAMES E. ROGAN
*Director of the United States Patent and Trademark Office*